US009042800B2

(12) United States Patent
Nishida et al.

(10) Patent No.: US 9,042,800 B2
(45) Date of Patent: May 26, 2015

(54) FIXING DEVICE

(71) Applicant: CANON KABUSHIKI KAISHA, Tokyo (JP)

(72) Inventors: Satoshi Nishida, Numazu (JP); Hideo Nanataki, Yokohama (JP); Takanori Mitani, Tokyo (JP); Shogo Kan, Suntou-gun (JP); Takeshi Shinji, Boise, ID (US); Kohei Okayasu, Mishima (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 13/927,516

(22) Filed: Jun. 26, 2013

(65) Prior Publication Data

US 2014/0003847 A1 Jan. 2, 2014

(30) Foreign Application Priority Data

Jun. 29, 2012 (JP) ..... 2012-147146

(51) Int. Cl.
*G03G 15/20* (2006.01)

(52) U.S. Cl.
CPC ..... *G03G 15/2064* (2013.01); *G03G 15/2017* (2013.01); *G03G 2215/0132* (2013.01); *G03G 2215/2019* (2013.01); *G03G 2215/2035* (2013.01)

(58) Field of Classification Search
CPC ..... G03G 15/2053; G03G 15/2064; G03G 15/2017; G03G 15/2085
USPC ..... 399/329
See application file for complete search history.

(56) References Cited

U.S. PATENT DOCUMENTS

| | | | | |
|---|---|---|---|---|
| 8,606,156 | B2 * | 12/2013 | Watanabe | 399/327 |
| 8,897,684 | B2 * | 11/2014 | Fromm | 399/323 |
| 8,897,687 | B2 * | 11/2014 | Ichiki et al. | 399/329 |
| 2005/0185996 | A1 * | 8/2005 | Oishi et al. | 399/329 |
| 2011/0236084 | A1 * | 9/2011 | Nishida et al. | 399/328 |
| 2012/0121304 | A1 * | 5/2012 | Tokuda et al. | 399/329 |

FOREIGN PATENT DOCUMENTS

| | | | |
|---|---|---|---|
| JP | 2002-083631 | A | 3/2002 |
| JP | 2003-114583 | A | 4/2003 |
| JP | 2005-351931 | A | 12/2005 |
| JP | 2009-109660 | A | 5/2009 |

* cited by examiner

*Primary Examiner* — Walter L Lindsay, Jr.
*Assistant Examiner* — Frederick Wenderoth
(74) *Attorney, Agent, or Firm* — Canon U.S.A., Inc. IP Division

(57) ABSTRACT

A fixing device configured to fix a toner image on a recording material by heating while conveying the recording material that bears the toner image by a nip portion, the fixing device includes a fixing roller having a rubber layer, a rotating member configured to form a contact portion between the rotating member and the fixing roller, and a pressure member configured to form the nip portion cooperatively with the fixing roller. In the fixing device, heat of the rotating member transfers to the fixing roller from the rotating member via the contact portion, and the contact portion includes a region where the pressure is increased after being decreased on a downstream side further than a center of the contact portion in the rotational direction of the rotating member.

14 Claims, 19 Drawing Sheets

FIXING DEVICE

BACKGROUND OF THE INVENTION

1. Field of the Invention

The present invention relates to a fixing device used in image forming apparatuses such as an electrophotographic copying machine and an electrophotographic printer.

2. Description of the Related Art

An external heating type fixing device is known as a fixing device used in an electrophotographic copying machine and an electrophotographic printer. Generally, this fixing device includes a fixing roller, a pressure member for forming a fixing nip portion cooperatively with the fixing roller, and a rotatable heating member for forming a heating contact portion cooperatively with the fixing roller. A rotatable endless belt which moves while making contact with a ceramic heater or a rotatable heating roller, in which a halogen heater is built therein, is used as the rotatable heating member. A recording material on which an unfixed toner image is borne is heated while being conveyed by the fixing nip portion, so that the toner image is fixed to the recording material.

In the external heating type fixing device, in a case where a jam occurs while the fixing nip portion conveys the recording material on which the unfixed toner image is borne, the toner may stick to a surface of the fixing roller. The toner adhering to the surface of the fixing roller may also stick to the surface of the rotatable heating member at the heating contact portion with the rotation of the fixing roller. After the toner adhering to the surface of the rotatable heating member is accumulated on the surface of the rotatable heating member and becomes a large lump, this lump toner may randomly fall on the recording material or return to the surface of the fixing roller, so as to smear the recording material to an extent that the image is regarded as a defective image.

Therefore, Japanese Patent Application Laid-Open No. 2003-114583 discusses a fixing device capable of causing release properties of the heating member with respect to the toner to be higher than release properties of the fixing roller. In the fixing device, because adhesion of the toner and the fixing roller is greater than adhesion of the toner and the heating member, the toner on the fixing roller is less likely to stick to the heating member and remains on the surface of the fixing roller. Therefore, the toner on the surface of the fixing roller can be gradually fixed to the recording material and discharged along with the rotation of the fixing roller, so that the recording material is less likely to be smeared to the extent that the image thereon is regarded as a defective image.

However, with the above-described external heating type fixing device, in a case where a recording paper is used as a recording material, a paper dust such as a paper fiber included in the recording paper may stick to the surface of the fixing roller at the fixing nip portion. The paper dust adhering to the surface of the fixing roller and the toner adhering to the surface of the fixing roller stick to the surface of the rotatable heating member to mix with each other, so as to form a sticking substance having a characteristic different from that of the toner. Therefore, the configurations discussed in Japanese Patent Application Laid-Open No. 2003-114583 may not be sufficient.

SUMMARY OF THE INVENTION

The present invention is directed to providing a fixing device capable of preventing a sticking substance such as toner adhering to a surface of a fixing roller from adhering to and accumulating on a rotatable heating member.

According to a first aspect of the invention, a fixing device configured to fix a toner image on a recording material by heating while conveying the recording material that bear the toner image by a nip portion, the fixing device includes a fixing roller having a rubber layer, a rotating member configured to form a contact portion between the fixing roller and the rotating member, and a pressure member configured to form the nip portion with the fixing roller. In the fixing device, heat of the rotating member transfers to the fixing roller from the rotating member via the contact portion, and the contact portion includes a region where pressure is increased after being decreased on a downstream side further than a center of the contact portion in the rotational direction of the rotating member.

According to a second aspect of the invention, a fixing device configured to fix a toner image on a recording material by heating while conveying the recording material that bears the toner image by a nip portion, the fixing device includes a cylindrical film, a contact portion forming member configured to make contact with an inner surface of the film, a fixing roller including a rubber layer, configured to form a contact portion with the contact portion forming member via the film, and a pressure member configured to form the nip portion with the fixing roller. In the fixing device, the rotating member transfers heat to the fixing roller via the contact portion, and the contact portion forming member includes a protruding portion protruding toward the fixing roller on a downstream side further than a center of the contact portion in the rotational direction of the film.

Further features and aspects of the present invention will become apparent from the following description of exemplary embodiments with reference to the attached drawings.

DESCRIPTION OF THE EMBODIMENTS

A first exemplary embodiment will be described.

Example of Image Forming Apparatus

Figure 1:
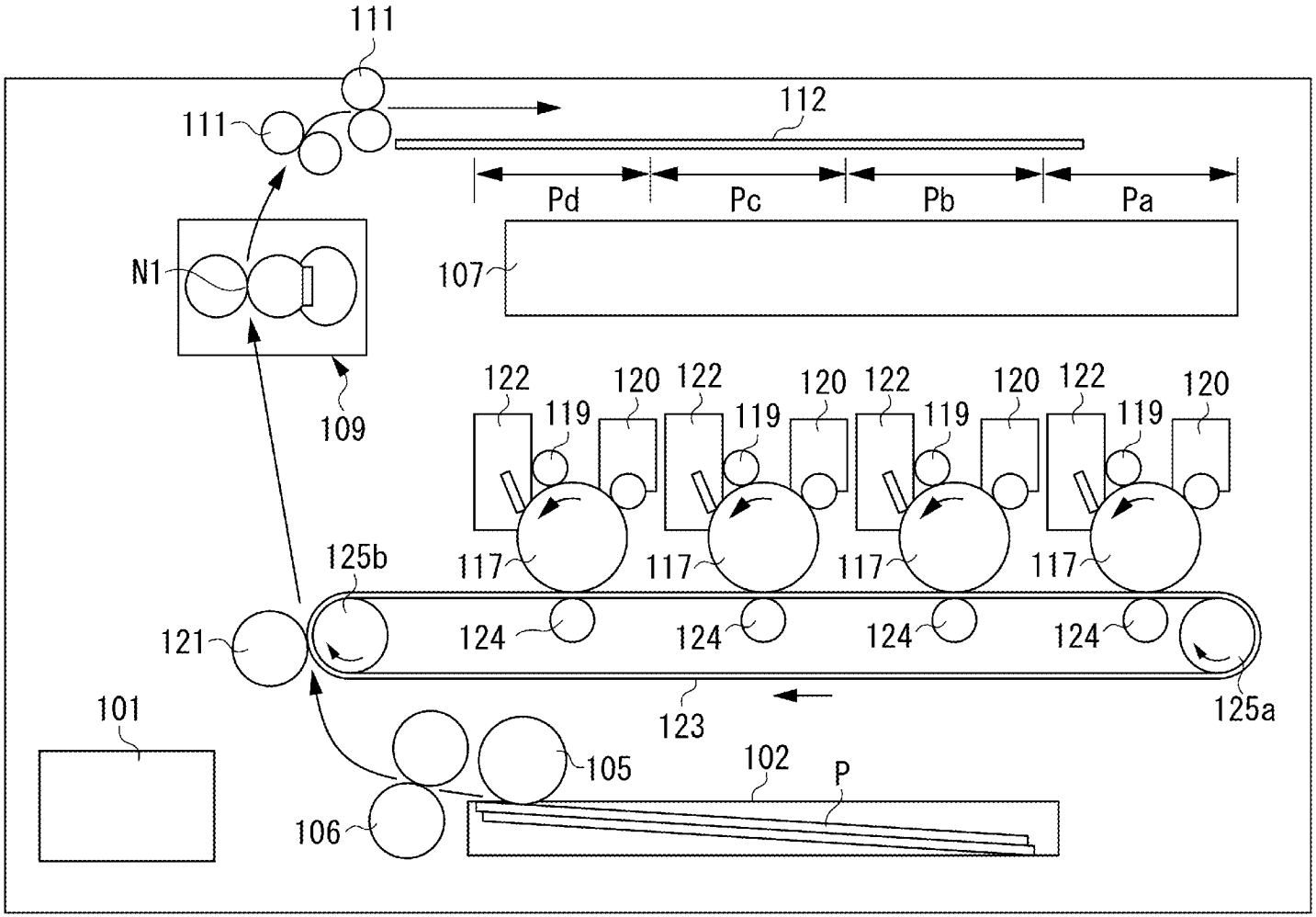
FIG. 1 is a cross-sectional view illustrating a general configuration of a cross-sectional side surface of an image forming apparatus.

FIG. 1 is a schematic cross-sectional view illustrating a general configuration of a cross-sectional side surface of an image forming apparatus on which a fixing device according to the present exemplary embodiment is mounted. This image forming apparatus is an electrophotographic laser beam printer.

The image forming apparatus described in the present exemplary embodiment is an in-line type apparatus in which a first through a fourth image forming units Pa, Pb, Pc, and Pd which form toner images by using toner in respective colors of cyan, magenta, yellow, and black are arranged side-by-side in a row in a predetermined direction. Each of the image forming units Pa, Pb, Pc, and Pd includes a drum-shape electrophotographic photosensitive member (hereinafter referred to as "photosensitive drum") 117 as an image bearing member.

In each of the image forming units Pa through Pd, a drum charging device 119 as a charging member and a scanning exposure device 107 as an exposure unit are disposed on a surrounding area of an outer circumferential surface of the photosensitive drum 117. Further, a developing device 120 as a developing unit and a drum cleaner 122 are disposed on the surrounding area of the surface of the photosensitive drum 117. Then, an intermediate transfer belt 123 as a conveyance member is provided across the photosensitive drums 117. This intermediate transfer belt 123 is stretched and wound on a driving roller 125*a* and a counter roller 125*b*.

On the inner circumferential surface (inner surface) side of the intermediate transfer belt 123, primary transfer rollers 124 as first transfer members are disposed, so as to pinch the intermediate transfer belt 123 between the photosensitive drums 117 and the primary transfer rollers 124. On the outer circumferential surface side of the intermediate transfer belt 123, a secondary transfer roller 121 as a second transfer member is disposed, so as to pinch the intermediate transfer belt 123 between the secondary transfer roller 121 and the counter roller 125*b*.

In the image forming apparatus according to the present exemplary embodiment, according to a print instruction output from an external apparatus (not illustrated) such as a host computer, a terminal apparatus on a network, or an external scanner, a control unit 101 executes predetermined image forming sequence. The control unit 101 is configured with a central processing unit (CPU) and memories such as a read-only memory (ROM) and a random access memory (RAM), and various programs necessary for the image forming sequence and image formation are stored in the memories.

An image forming operation of the image forming apparatus according to the present exemplary embodiment will be described with reference to FIG. 1. According to the image forming sequence executed in response to the print instruction, the control unit 101 sequentially drives each of the image forming units Pa, Pb, Pc, and Pd. First, each photosensitive drum 117 is rotated in a direction of an arrow at a predetermined circumferential velocity (process speed), while the driving roller 125*a* rotates the intermediate transfer belt 123 in a direction of an arrow at a circumferential velocity corresponding to the rotational circumferential velocity of the photosensitive drum 117. On the image forming unit Pa for cyan as a first color, the surface of the photosensitive drum 117 is uniformly charged at predetermined polarity and potential by the drum charging device 119. Then, the scanning exposure device 107 expose and scan the charging surface of the photosensitive drum 117 to and with a laser beam corresponding to image data (image information) that is output from the external apparatus. With this operation, an electrostatic latent image (electrostatic image) according to the image data is formed on the charging surface on the surface of the photosensitive drum 117. Then, the developing device 120 develops the electrostatic latent image by using a cyan toner. Through this, a cyan toner image (developed image) is formed on the surface of the photosensitive drum 117.

Each of the operations of charging, exposing, and developing are similarly performed by the image forming unit Pb for magenta as a second color, the image forming unit Pc for yellow as a third color, and the image forming unit Pd for black as a fourth color. The toner images in respective colors formed on each of the photosensitive drums 117 are sequentially overlapped and transferred onto the surface of the intermediate transfer belt 123 by the primary transfer rollers 124 at primary transfer nip portions between the surfaces of the photosensitive drums 117 and the surface of the intermediate transfer belt 123. As a result, a full color toner image is borne by the surface of the intermediate transfer belt 123.

After transfer of the toner image, the drum cleaners 122 remove residual transfer toner remained on the surfaces of the photosensitive drums 117, so that the surfaces of the photosensitive drums 117 are used for the next image formation.

On the other hand, a recording material such as a recording paper (hereinafter, referred to as "recording material") P is fed one-by-one from a paper feeding cassette 102 and conveyed to a registration roller 106 by a feeding roller 105. This recording material P is conveyed to a secondary transfer nip portion between the surface of the intermediate transfer belt 123 and the outer circumferential surface of the secondary transfer roller 121 by the registration roller 106. During the conveyance period, the toner image on the surface of the intermediate transfer belt 123 is transferred to the recording material P by the secondary transfer roller 121. Through the operation, an unfixed full-color toner image is borne by the recording material P.

The recording material P which bears the full-color toner image is introduced to a fixing nip portion N1, which will be described below, of a fixing device 109 provided on a fixing portion. Then, heat and nip pressure are applied to the toner image while the recording material P is pinched and conveyed by the fixing nip portion N1, so that the toner image on the recording material P is heated and fixed on the recording material P. The recording material P passing through the fixing nip portion N1 is discharged to a discharge tray 112 by discharge rollers 111.

Fixing Device

In the following descriptions, with respect to a fixing device and members constituting the fixing device, "lengthwise direction" is a direction orthogonal to a conveyance direction of the recording material on a surface of the recording material. "Short direction" is a direction parallel to the conveyance direction of the recording material on a surface of the recording material. "Length" is a dimension in the lengthwise direction, whereas "width" is a dimension in the short direction.

Figure 2:
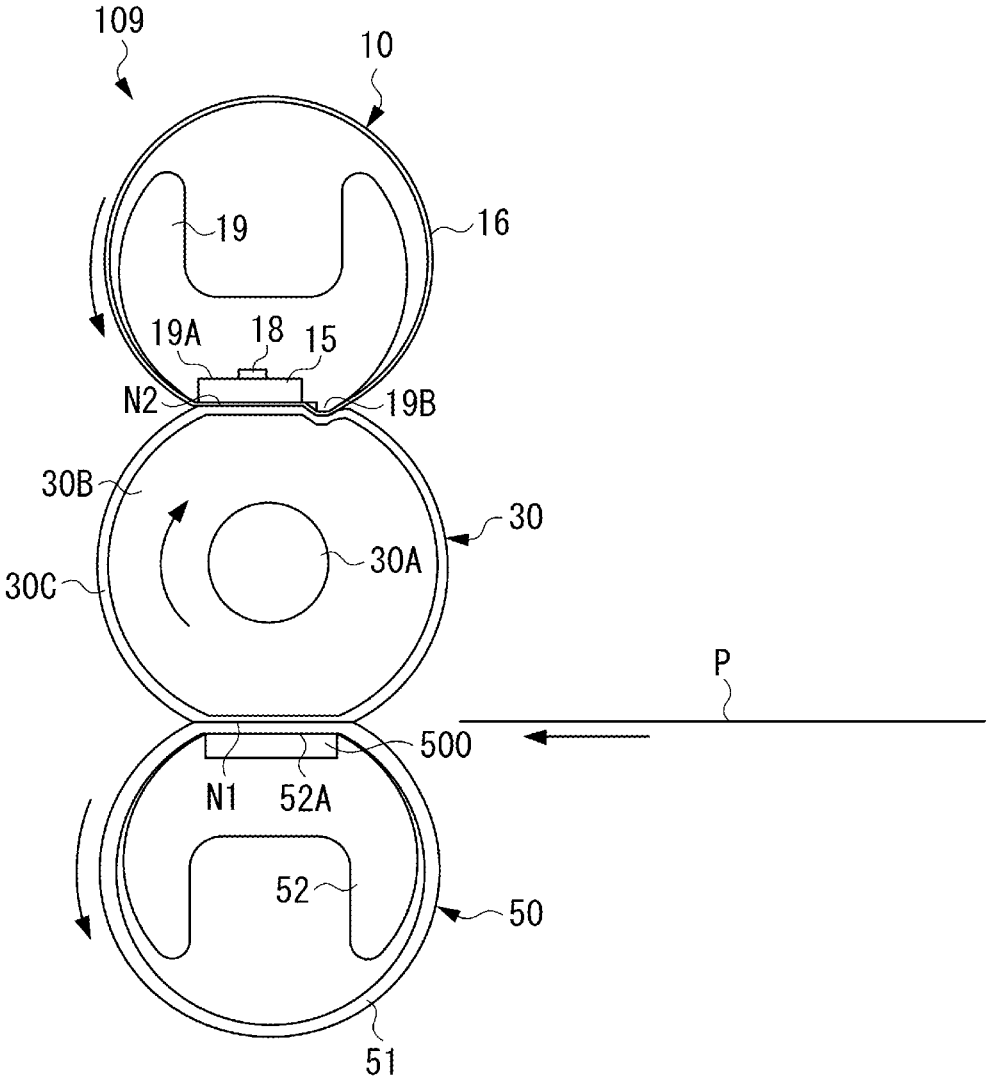
FIG. 2 is a cross-sectional view illustrating a general configuration of a fixing device according to a first exemplary embodiment.
Figure 3:
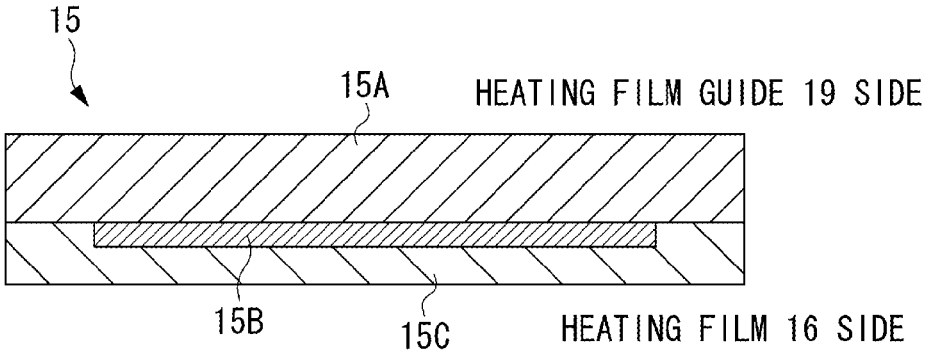
FIG. 3 is a cross-sectional view illustrating a general configuration of a ceramic heater according to the second exemplary embodiment.
Figure 4:
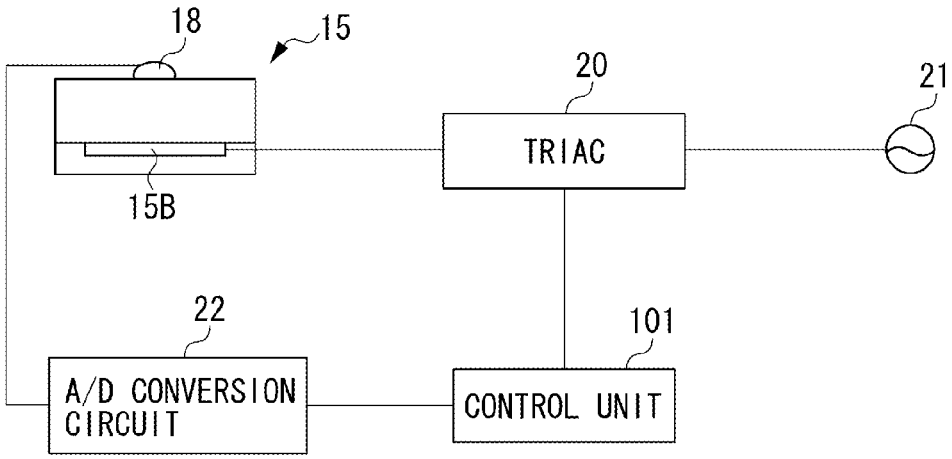
FIG. 4 is an explanatory diagram illustrating a heater and an energization control system according to the first exemplary embodiment.

FIG. 2 is a cross-sectional view illustrating a general configuration of the fixing device 109 according to the present exemplary embodiment. FIG. 3 is a schematic cross-sectional view illustrating a general configuration of a ceramic heater 15 used in the fixing device 109 according to the present exemplary embodiment. FIG. 4 is an explanatory diagram illustrating the ceramic heater 15 and an energizing control system.

The fixing device 109 according to the present exemplary embodiment is an external heating type fixing device including a fixing roller 30, a heating unit 10, and a pressure unit 50 as a pressure member.

The fixing roller 30 includes a cylindrical shaft like core metal 30A formed of a metallic material such as iron, stainless steel (SUS), or aluminum. Further, an elastic layer 30B primarily formed of silicon rubber is formed on an outer circumferential surface of the core metal 30A, and a release layer 30C primarily formed of polytetrafluoroethylene (PTFE), copolymer of tetrafluoroethylene and perfluoroalkoxyethylene (PFA), or copolymer of tetrafluoroethylene and hexafluoropropylene (FEP) is formed on an outer circumferential surface of the elastic layer 30B.

In the fixing roller 30, both end portions in the lengthwise direction of the core metal 30A are rotatably supported by side plates (not illustrated) provided on both sides in the lengthwise direction of a device frame (not illustrated) via shaft bearings (not illustrated). Accordingly, in the fixing roller 30, the elastic layer 30B is provided on the outer side of the core metal 30A that serves as a rotational center shaft of the fixing roller 30.

The heating unit 10 includes a ceramic heater (hereinafter, referred to as "heater") 15 which serves as a heating source as well as a heating contact portion forming member. The heating unit 10 further includes a cylindrical heating film (endless film) 16 as a rotatable heating member, and a heating film guide 19 as a supporting member for supporting the inner surface of the heating film 16. The heating film guide 19 is formed in such a manner that a cross-sectional face thereof becomes an approximately concave shape by using a heat resistant material such as a liquid crystal polymer (LCP). Further, both end portions in the lengthwise direction of the heating film guide 19 are supported by the side plates provided on both sides in the lengthwise direction of the device frame. The heater 15 is supported by a groove 19A provided on a flat face of the heating film guide 19 in the lengthwise direction of the heating film guide 19, so as to cause the heating film 16 to externally fit loosely onto the heating film guide 19 that supports the heater 15. The heater 15 includes a thin plate like heater substrate 15A primarily formed of ceramics such as alumina or aluminum nitride. On a substrate surface of the heater substrate 15A on a side of the heating film 16, a heat generation resistor 15B primarily formed of silver and palladium is disposed in the lengthwise direction of the heater substrate 15A. Further, on this substrate surface, a protective layer 15C primarily formed of glass or heat-resistant resin such as fluorine resin and polyimide is disposed to cover the heat generation resistor 15B.

The heating film 16 is formed so that the length of an inner circumference of the heating film 16 is longer than the length of an outer circumference of the heating film guide 19, and externally fitted loosely onto the heating film guide 19 without tension. As a layer structure of the heating film 16, a two-layer structure, in which an outer circumferential surface of a film base layer primarily formed of polyimide is covered with a surface layer primarily formed of PFA, is employed.

The heating unit 10 is disposed in parallel to the fixing roller 30 on the upper side of the fixing roller 30 in FIG. 2. Then, both end portions thereof in the lengthwise direction of the heating film guide 19 are urged toward the fixing roller 30 in a direction orthogonal to a generatrix direction of the fixing roller 30 by a pressure spring (not illustrated). The protective layer 15C of the heater 15 and the outer surface of the heating film guide 19 are pressed against the surface of the fixing roller 30 via the heating film 16. With this configuration, the elastic layer 30B of the fixing roller 30 is compressed and elastically deformed at a position corresponding to the outer surface of the protective layer 15C of the heater 15 and the outer surface of the heating film guide 19, so that the surface of the fixing roller 30 and the surface of the heating film 16 form a predetermined width of a heating contact portion N2. Accordingly, the fixing roller 30, cooperatively with the heating film guide 19 and the heater 15, forms the heating contact portion N2 via the heating film 16.

The pressure unit 50 includes a pressure plate 500 as a nip portion forming member, a cylindrical pressure film (endless film) 51 as a rotatable pressure member, and a pressure film guide 52 for guiding the inner surface of the pressure film 51. A metallic material such as aluminum having excellent thermal conductivity is used for the pressure plate 500. The pressure film guide 52 is formed in such a manner that the cross-sectional face thereof becomes an approximately concave shape by using a heat resistant material such as LCP. Then, both end portions in the lengthwise direction of the pressure film guide 52 are supported by the side plates provided on both sides in the lengthwise direction of the device frame. Further, the pressure film 51 is externally fitted loosely onto the pressure film guide 52.

The pressure film 51 is formed in such a manner that the length of an inner circumstance of the pressure film 51 is longer than the length of an outer circumstance of the pressure film guide 52, so as to be externally fitted loosely onto the pressure film guide 52 without tension. As a layer structure of the pressure film 51, a two-layer structure, in which an outer circumferential surface of a film base layer primarily formed of polyimide is covered with a surface layer primarily formed of PFA, is employed.

As illustrated in FIG. 2, the pressure unit 50 is arranged in parallel to the fixing roller 30. Then, both end portions in the lengthwise direction of the pressure film guide 52 are urged toward the fixing roller 30 in a direction orthogonal to a generatrix direction of the fixing roller 30 by a pressure spring (not illustrated). Specifically, the pressure plate 500 held by a groove 52A of the pressure film guide 52 is urged toward the surface of the fixing roller 30 via the pressure film 51. With this configuration, the elastic layer 30B of the fixing roller 30 is compressed and elastically deformed at a position corresponding to the pressure plate 500, so that the surface of the fixing roller 30 and the surface of the pressure film 51 form a predetermined width of a fixing nip portion N1. Accordingly, the pressure plate 500 and the fixing roller 30 form the fixing nip portion N1 via the pressure film 51.

Fixing processing of the fixing device 109 will be described with reference to FIG. 2 and FIG. 4. The control unit 101 rotationally drives a driving motor as a driving source (not illustrated) according to the image forming sequence executed in response to the print instruction. Rotation of an output shaft of the driving motor is transmitted to the core metal 30A of the fixing roller 30 through a predetermined gear train (not illustrated). With the rotation, the fixing roller 30 rotates in a direction of an arrow at a predetermined circumferential velocity (process speed). At the fixing nip portion N1, the rotation of the fixing roller 30 is transmitted to the pressure film 51 by a frictional force generated between the surface of the fixing roller 30 and the surface of the pressure film 51. Then, the pressure film 51 rotates in a direction of an arrow by following the rotation of the fixing roller 30, while the inner circumferential surface of the pressure film 51 makes contact with the pressure plate 500.

Further, at the heating contact portion N2, the rotation of the fixing roller 30 is transferred to the heating film 16 by a frictional force generated between the surface of the fixing roller 30 and the surface of the heating film 16. With the rotation, the heating film 16 rotates in a direction of an arrow by following the rotation of the fixing roller 30 while the inner circumferential surface of the heating film 16 makes contact with an outer surface of the protective layer 15C of the heater 15.

Further, the control unit 101 turns on a triac 20 according to the image forming sequence. The triac 20 controls the power applied by an alternate current (AC) power source 21, and starts distributing the power to the heat generation resistor 15B of the heater 15. With this energization, the heat generation resistor 15B generates heat, so that the heater 15 rapidly raises the temperature thereof to heat the heating film 16. The temperature of the heater 15 is detected by a thermistor 18 as a temperature detecting member which is disposed on a substrate face of the heater substrate 15A on the heating film guide 19 side. The control unit 101 takes in an output signal (temperature detection signal) from the thermistor 18 via an analog-digital (A/D) conversion circuit 22, and based on the output signal, the control unit 101 controls the triac 20 to maintain the temperature of the heater 15 at a predetermined fixing temperature (target temperature). Therefore, the temperature of the heater 15 is adjusted to a predetermined fixing temperature.

The surface of the rotating fixing roller 30 is heated by the heater 15 at the heating contact portion N2 via the heating film 16. Through this, the surface of the fixing roller 30 is provided with an amount of heat that is necessary and sufficient for fixing an unfixed toner image T borne by the recording material P at the fixing nip portion N1. In a state where the control unit 101 drives the driving motor and controls the heater 15, the recording material P which bears the unfixed toner image T is introduced to the fixing nip portion N1 in an orientation in which the toner image bearing surface thereof faces the surface of the fixing roller 30. This recording material P is pinched and conveyed by the surface of the fixing roller 30 and the surface of the pressure film 51 at the fixing nip portion N1. In this conveyance process, the toner image T is fused by being heated on the surface of the fixing roller 30, and the pressure from the fixing nip portion N1 is applied to the fused toner image T. Through this, the toner image T is fixed onto the surface of the recording material P.

Pressure Distribution of Heating Contact Portion N2

Figure 5A:
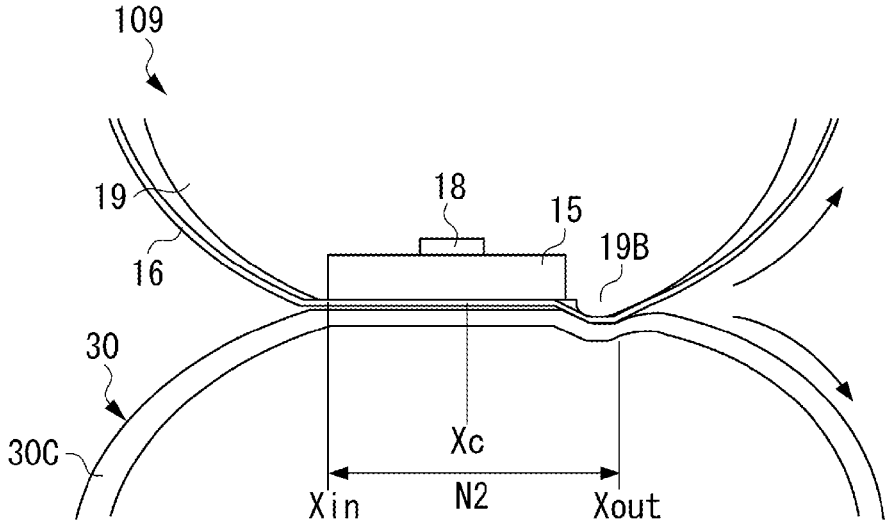
FIG. 5A is a cross-sectional view illustrating a general configuration of a heating contact portion according to the first exemplary embodiment.
Figure 5B:
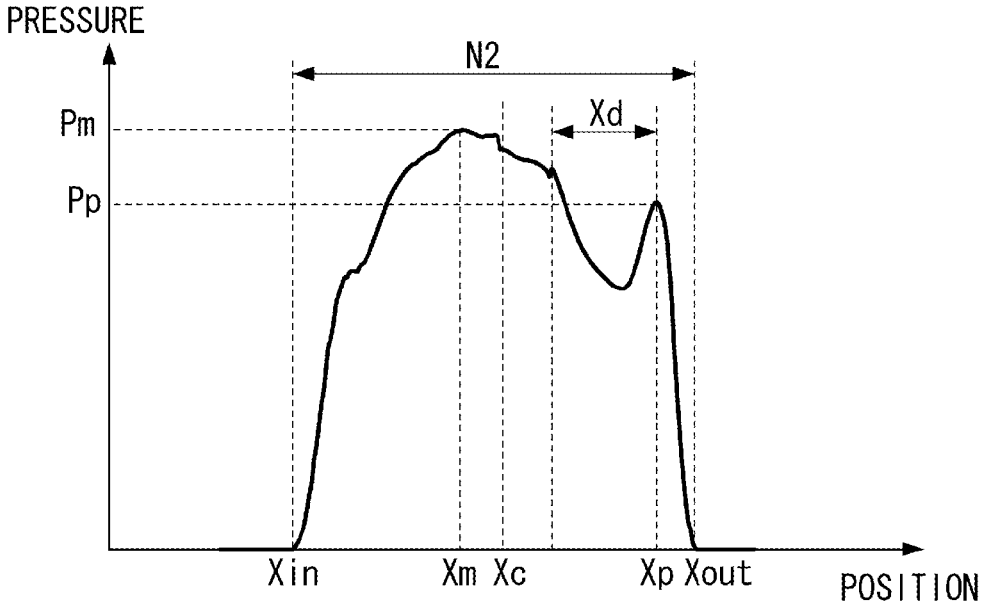
FIG. 5B is a graph illustrating pressure distribution of the heating contact portion according to the first exemplary embodiment.

FIG. 5A is a cross-sectional view of the heating contact portion N2 according to the present exemplary embodiment, and FIG. 5B is a graph illustrating pressure distribution of the heating contact portion N2 according to the present exemplary embodiment.

The fixing device 109 according to the present exemplary embodiment includes a pressure decreasing region Xd where the pressure between the surface of the heating film 16 and the surface of the fixing roller 30 at the heating contact portion N2 is increased after being decreased.

The pressure decreasing region Xd is located on a downstream side further than a center Xc of the heating contact portion N2 in the rotational direction of the heating film 16. The center Xc of the heating contact portion N2 in the rotational direction of the heating film 16 is the center of a heating contact portion entrance Xin and a heating contact portion exit Xout in FIG. 5.

Method for Measuring Pressure Distribution of Heating Contact Portion N2

Figure 6:
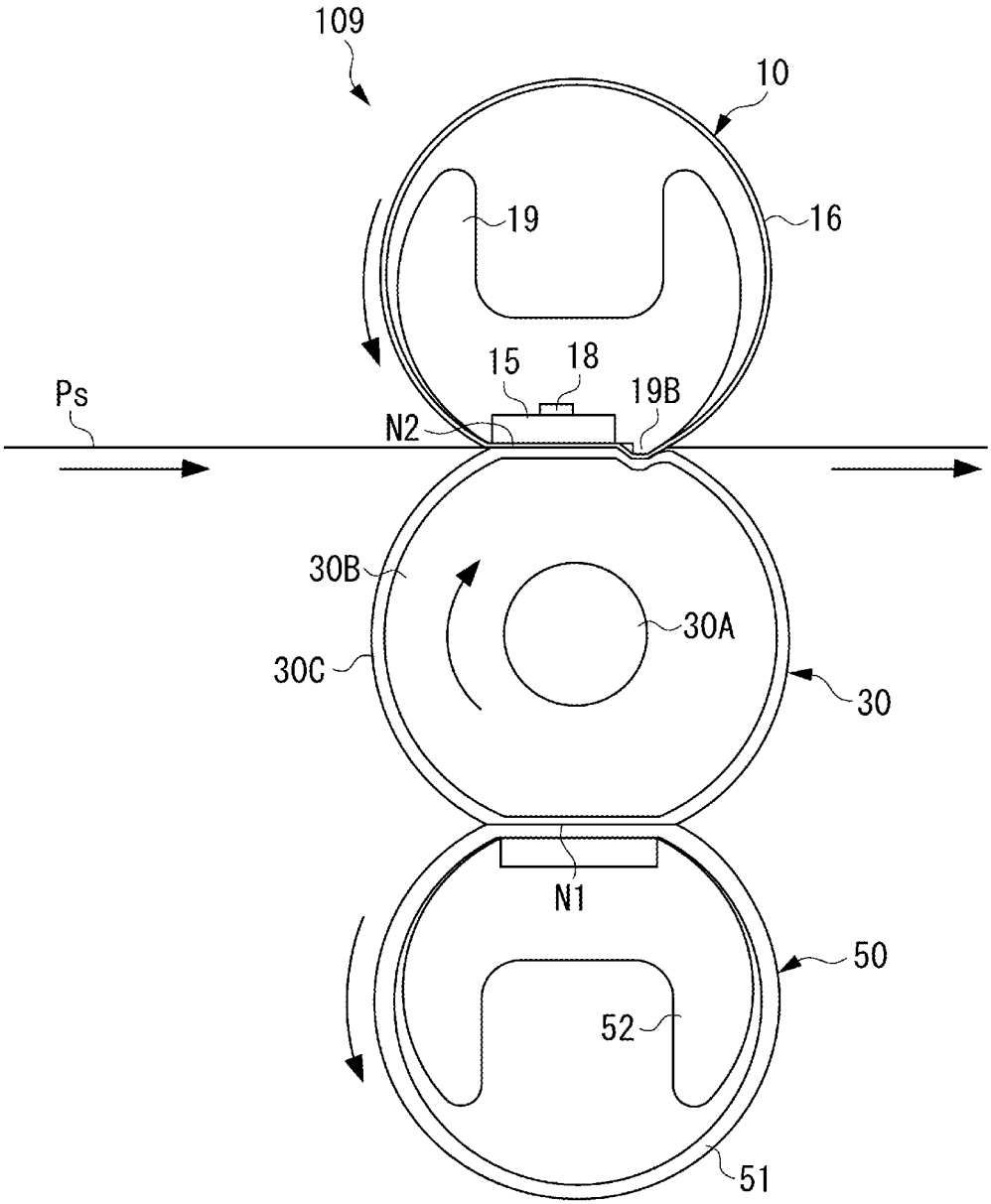
FIG. 6 is a cross-sectional view of the fixing device in which pressure distribution of the heating contact portion according to the first exemplary embodiment has been measured.

A method for measuring the pressure distribution of the heating contact portion N2 illustrated in FIG. 5B will be described. FIG. 6 is a cross-sectional view of the fixing device 109 in a case where the pressure distribution of the heating contact portion N2 is measured. A recording material type pressure distribution measurement element is used to measure the pressure distribution of the heating contact portion N2. In the present exemplary embodiment, the measurement is carried out by using a film type pressure distribution measurement system, "PINCH" (Nitta Corporation). As illustrated in FIG. 6, a pressure distribution measurement recording material Ps is fed into the heating contact portion N2 by rotating the fixing roller 30 in the same direction as that in a normal printing operation. After the pressure distribution measurement recording material Ps has been pinched and conveyed by the rotation of the fixing roller 30 to a position where the pressure of the heating contact portion N2 can be sufficiently detected, the fixing roller 30 is rested, and the pressure distribution is measured in the resting state.

Method for Forming Pressure Decreasing Region Xd

As a method for forming the pressure distribution including the pressure decreasing region Xd in the heating contact portion N2, a configuration in which a protruding portion 19B is provided in a vicinity of a downstream of the heating contact portion N2 of the heating film guide 19 may be considered. The protruding portion 19B is protruded toward the fixing roller 30 side further than a sliding surface of the heater 15 with the heating film 16.

The fixing roller 30 is pressed by the heating pressure contact forming member (mainly by the heater 15) via the heating film 16, so as to be deformed elastically. As a result, the pressure thereof has a peak value Pm at a position Xm located on the upstream side further than the center Xc of the heating contact portion N2 in the rotational direction of the heating film 16. This position Xm is indicated as a first pressure peak portion Xm. Distribution of the pressure is such that the pressure is gradually lowered from the first pressure peak portion Xm toward the upstream and the downstream in the rotational direction of the heating film 16.

In a case where the protruding portion 19B is not provided, elastic deformation of the fixing roller 30 becomes smaller in a vicinity of the downstream of the heating contact portion N2 in the rotational direction of the heating film 16, and in this region, the contact pressure between the fixing roller 30 and the heating film 16 is simply lowered.

On the contrary, in a case where the protruding portion 19B is provided in the above-described position, the protruding portion 19B causes the fixing roller 30 to be elastically deformed strongly via the heating film 16. As a result, in the pressure decreasing region Xd where the pressure of the heating contact portion N2 is increased after being decreased temporarily, the pressure has a peak value Pp at a position Xp on the downstream thereof in the rotational direction of the heating film 16. This position is indicated as a second pressure peak portion Xp.

In other words, the pressure decreasing region Xd where the pressure is increased after being decreased temporarily is formed in a region between the first pressure peak portion Xm and the second pressure peak portion Xp.

As illustrated in FIG. 5B, it is desirable that the pressure decreasing region Xd is provided on the downstream side further than the first pressure peak portion Xm in the rotational direction of the heating film 16, and on the upstream side further than the second pressure peak portion Xp in the rotational direction of the heating film 16. Further, it is desirable that the pressure decreasing region Xd is provided on a downstream region further than the center Xc of the heating contact portion N2 in the rotational direction of the heating film 16.

In addition, the pressure of the second pressure peak portion Xp may be greater than that of the first pressure peak portion Xm.

It is advantageous that the second pressure peak portion Xp be provided at a position in a vicinity of the downstream of the heating contact portion N2, and a position in a vicinity of an exit of the heating contact portion N2 is much more advantageous.

Furthermore, the position, the height, and the shape of the contact surface of the protruding portion 19B are not limited to the present exemplary embodiment.

Problem Regarding Sticking Toner

Figure 7:
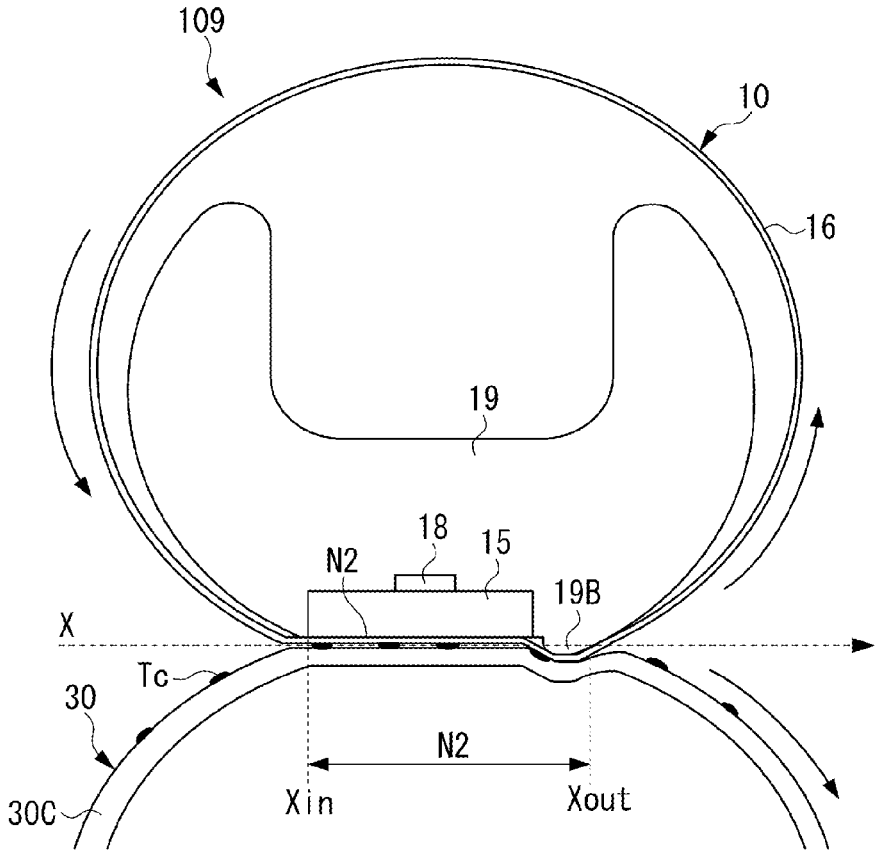
FIG. 7 is a diagram illustrating a transfer pathway of a sticking substance at the heating contact portion according to the first exemplary embodiment.

In the above-described fixing operations, when the toner image T on the recording material P is fixed to the recording material P, paper dust such as paper fibers and loading materials formed of inorganic substances such as calcium carbonate and talc, which are included in the recording material P, fall and stick to the surface of the fixing roller 30. A sticking substance Tc is generated when traces of toner adhering to the surface of the fixing roller 30 sticks to and mixes with traces of the paper dust formed of the inorganic substances. As illustrated in FIG. 7, with the rotation of the fixing roller 30, the sticking substance Tc also makes contact with the surface of the heating film 16 at the heating contact portion N2. If the sticking substance Tc is transferred to the surface of the heating film 16, release properties on the surface of the heating film 16 is degraded, so as to cause the toner and the paper dust to further stick to the sticking substance Tc to make the sticking substance Tc larger. Since this sticking substance Tc is mixed with the paper dust, the sticking substance Tc is less likely to be softened even if heat is applied thereto, and the adhesion thereof is also low. Therefore, increasing the release properties on the surface of the heating film 16, or having a temperature difference between the surface of the heating film 16 and the surface of the fixing roller 30 to transfer the sticking substance Tc may not be a sufficient solution.

The sticking substance Tc adhering to the surface of the heating film 16 causes variation in the amount of heat applied to the fixing roller 30, so as to cause an image defect such as uneven gloss of an image or streaks on the image to occur. Further, after the sticking substance Tc becomes a large lump on the surface of the heating film 16, this sticking substance Tc randomly falls on the recording material P, or moves to the surface of the fixing roller 30 to transfer to the recording material P to cause image defects to occur.

Mechanism for Suppressing Sticking Substance Sticking to Surface of Heating Film 16

With the fixing device 109 according to the present exemplary embodiment, sticking substances sticking to the heating film 16 can be suppressed. The mechanism thereof will be described below. An operation of each member in heating contact portion N2 is illustrated in FIG. 8A, and pressure distribution of the heating contact portion N2 is illustrated in FIG. 8B.

Figure 8A:
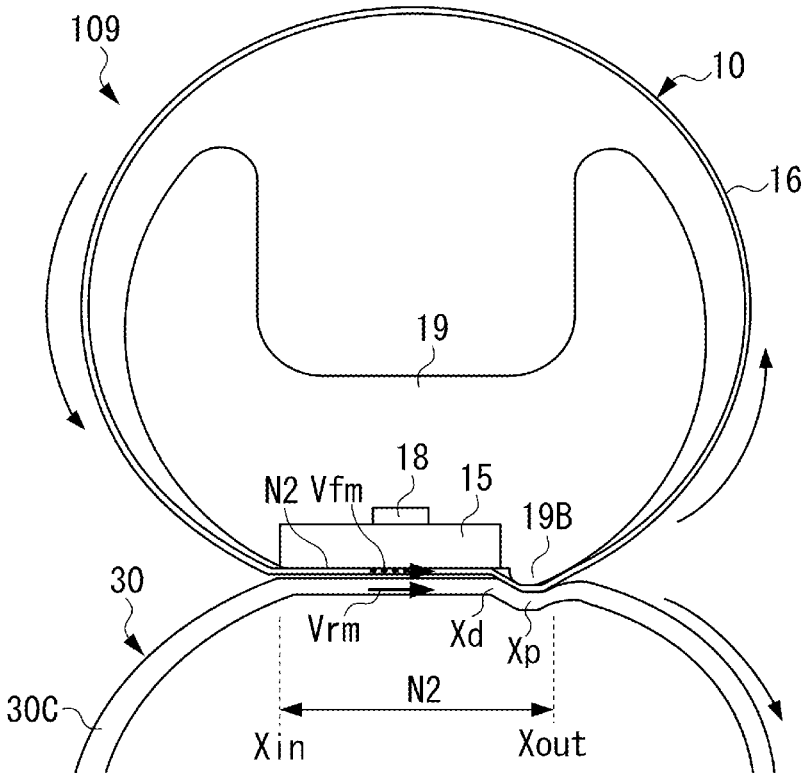
FIG. 8A is a diagram illustrating a velocity relationship between the fixing roller and a heating film at the heating contact portion according to the first exemplary embodiment.
Figure 8B:
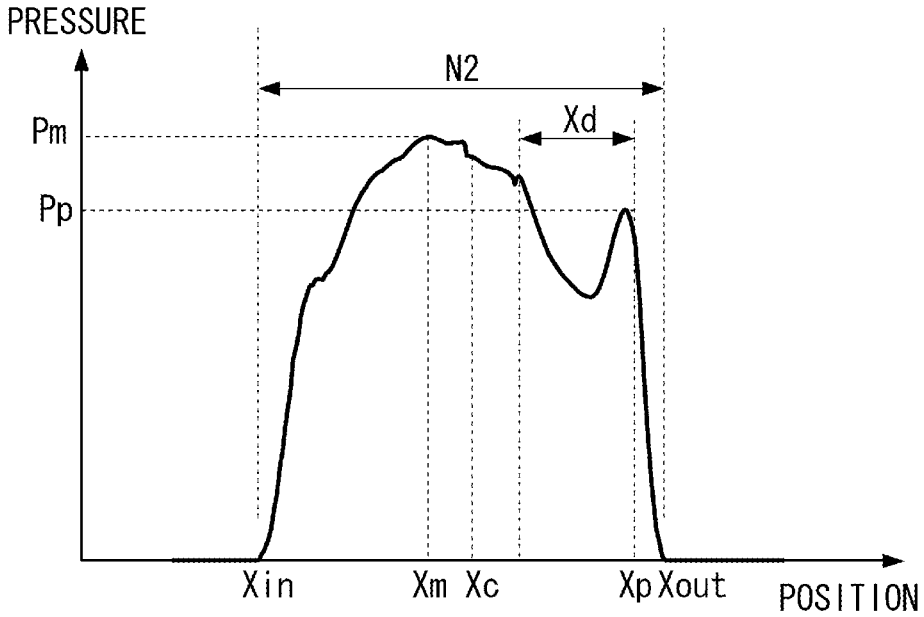
FIG. 8B is a graph illustrating pressure distribution of the heating contact portion according to the first exemplary embodiment.

In FIG. 8A, the fixing roller 30 rotates in a direction of an arrow, so that the surface of the fixing roller 30 makes contact with the surface of the heating film 16. In the rotational direction of the fixing roller 30, a position Xin where the surface of the fixing roller 30 starts making contact with the surface of the heating film 16 is set to an entrance of a heating contact portion N2, and a position Xout where the surface of the fixing roller 30 starts separating from the surface of the heating film 16 is set to an exit of a heating contact portion N2.

As described above, the second pressure peak portion Xp is formed by the protruding portion 19B provided on the heating film guide 19, and the pressure decreasing region Xd where the pressure is increased after being decreased is formed between the first pressure peak portion Xm and the second pressure peak portion Xp.

Deformation state of the elastic layer 30B of the fixing roller 30 at respective positions of the heating contact portion entrance Xin, the first pressure peak portion Xm, the pressure decreasing region Xd, the second pressure peak portion Xp, and the heating contact portion exit Xout will be described. In addition, a peripheral speed difference between the surface of the heating film 16 and the surface of the fixing roller 30 at the above-described positions will be described.

At the position of the heating contact portion entrance Xin, the fixing roller 30 as an elastic member is compressed and deformed to start making contact with the surface of the heating film 16. By making the position of the first pressure peak portion Xm as the center, the surface of the fixing roller 30 and the surface of the heating film 16 are pressure contacted, and the heating film 16 is driven by the fixing roller 30 due to a frictional force.

The frictional force acting between the heating film 16 and the surface of the fixing roller 30 is large at the first pressure peak portion Xm. Therefore, in a state where the fixing roller 30 steadily rotates, a s peripheral speed difference $\Delta Vm$ between a circumferential speed Vrm of the surface of the fixing roller 30 and a circumferential speed Vfm of the heating film 16 is small at the first pressure peak portion Xm.

Figure 9:
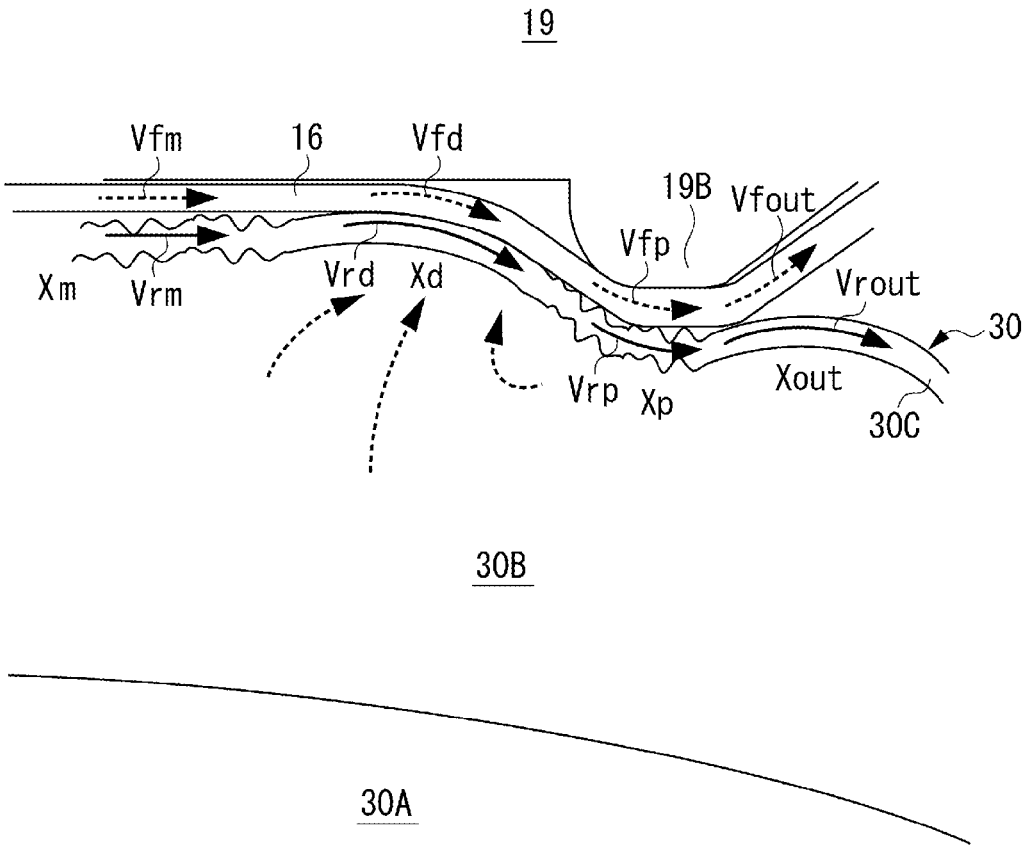
FIG. 9 is a cross-sectional view illustrating deformation of a surface of the fixing roller at a pressure decreasing region of the heating contact portion according to the first exemplary embodiment.

FIG. 9 is a cross-sectional view illustrating elastic deformation of the fixing roller 30 and circumferential speed of each member in a vicinity of the pressure decreasing region Xd in the heating contact portion N2.

At the first pressure peak portion Xm, the elastic layer 30B of the fixing roller 30 which closely sticks to the heating film 16 moves to the pressure decreasing region Xd with the rotation of the fixing roller 30.

The pressure decreasing region Xd is sandwiched between the first pressure peak portion Xm located on the upstream side in the rotational direction of the heating film 16 and the second pressure peak portion Xp located on the downstream side further than the pressure decreasing region Xd in the rotational direction of the heating film 16, and the pressure thereof is partially low.

Accordingly, in the pressure decreasing region Xd, the elastic layer 30B of the fixing roller 30 expands in a radial direction so as to restore from the compressed state. In other words, in the pressure decreasing region Xd, the elastic layer 30B of the fixing roller 30 has an outer diameter larger than that in a position of the first pressure peak portion Xm where a compressed amount is larger.

When the elastic layer 30B of the fixing roller 30 restores from the compressed state, the elastic layer 30B also expands in a direction with lower pressure in the rotational direction of the fixing roller 30 in addition to expand in the radial direction of the fixing roller 30.

However, the elastic layer 30B of the fixing roller 30 according to the present exemplary embodiment is pinched between two pressure peaks in the pressure decreasing region Xd, and thus it is not possible to expand in the rotational direction of the fixing roller 30.

Accordingly, in the pressure decreasing region Xd, the elastic layer 30B of the fixing roller 30 restores and expands in the radial direction of the fixing roller 30, so that the outer diameter of the fixing roller 30 easily become larger.

On the other hand, the heating film 16 elastically deforms not as much as the surface of the fixing roller 30. Therefore, the circumferential speed Vfd of the heating film 16 in the pressure decreasing region Xd is the same as the circumferential speed Vfm at the position of the first pressure peak portion Xm.

Accordingly, a peripheral speed difference ΔVd between the surface of the fixing roller 30 and the surface of the heating film 16 is generated in the pressure decreasing region Xd.

$$\Delta Vd = Vrd - Vfd$$

In the pressure decreasing region Xd, the surface of the fixing roller 30 travels faster than the surface of the heating film 16 by the peripheral speed difference ΔVd. Therefore, with the rotation of the fixing roller 30, the surface of the fixing roller 30 and the surface of the heating film 16 are displaced from each other. As a result, a shearing force is generated at an interface between the surface of the fixing roller 30 and the surface of the heating film 16. The effect of the shearing force will be described below.

Figure 10:
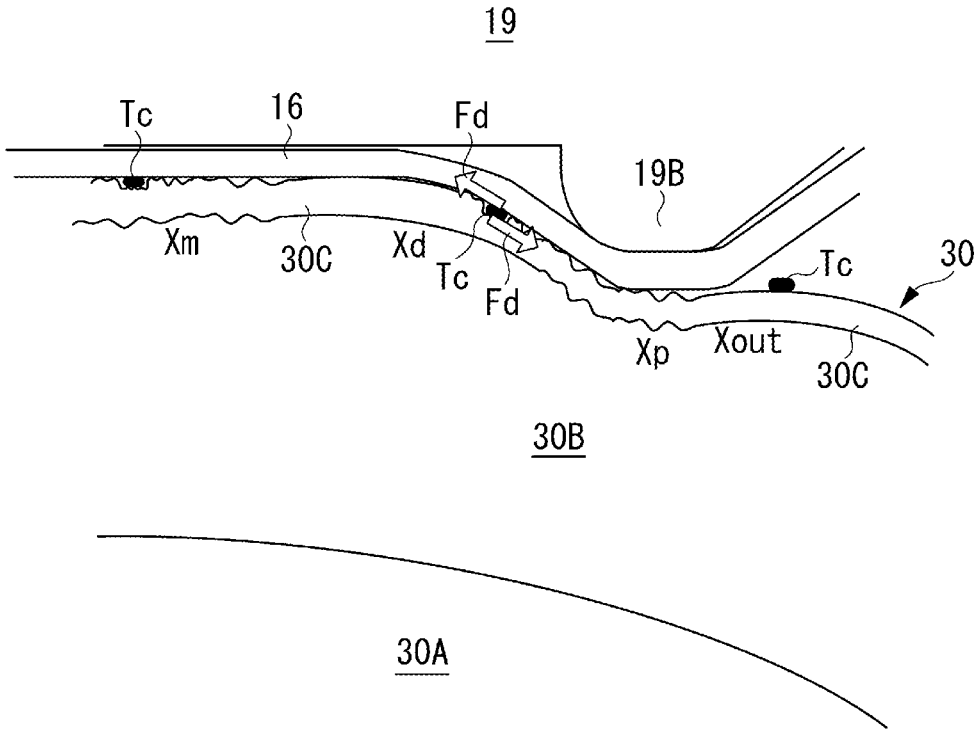
FIG. 10 is a diagram illustrating a shearing force applied to the sticking substance in the pressure decreasing region of the heating contact portion according to the first exemplary embodiment.

FIG. 10 is a cross-sectional view illustrating a force applied to the sticking substance Tc at the heating contact portion N2. Operations acting on the surface of the fixing roller 30, the surface of the heating film 16, and the sticking substance Tc in the heating contact portion N2 will be described.

The sticking substance Tc adhering to the fixing roller 30 enters the heating contact portion N2 with the rotation of the fixing roller 30, and is pressurized by being pinched between the fixing roller 30 and the heating film 16.

The adhesion force of the sticking substance Tc to the surface of the fixing roller 30 is proportionate to a size of a contact area of the sticking substance Tc with respect to the surface of the fixing roller 30. Likewise, the adhesion force of the sticking substance Tc to the surface of the heating film 16 is proportionate to a size of a contact area of the sticking substance Tc with respect to the heating film 16.

In the heating contact portion N2, since the fixing roller 30 is an elastic member, the surface thereof is deformed according to the shape of the sticking substance Tc, and thus the contact area with the sticking substance Tc can be increased easily.

On the other hand, although the elasticity of the heating film 16 is not as much as that of the fixing roller 30, the surface layer thereof will be softened owing to heat of the heating contact portion N2. Therefore, while the heating film 16 passes through the heating contact portion N2, the surface thereof is gradually deformed to increase the contact area with the sticking substance Tc.

Further, with respect to the sticking substance Tc itself, since the toner and the paper dust are mixed thereto, the sticking substance Tc is fused not as much as the toner as a single substance. However, when the sticking substance Tc is heated and pressurized by the heating contact portion N2 for a long period of time, the shape thereof will be deformed following the surfaces of the fixing roller 30 and the heating film 16.

In a region from the heating contact portion entrance Xin to the first pressure peak portion Xm of the heating contact portion N2, the sticking substance Tc closely sticks to both the surface of the fixing roller 30 and the surface of the heating film 16.

However, when the sticking substance Tc reaches the pressure decreasing region Xd, a shearing force Fd is applied between the sticking substance Tc and the surface of the heating film 16 and between the sticking substance Tc and the surface of the fixing roller 30.

By receiving the shearing force Fd, the sticking substance Tc is deformed or moved from the state where the sticking substance Tc closely sticks to the surfaces of the fixing roller 30 and the heating film 16, so that the closely-adhering state with respect to the fixing roller 30 or the heating film 16 is cancelled. Specifically, adhesion force of the sticking substance Tc to the fixing roller 30 or the heating film 16 is lowered, or the sticking substance Tc is separated from the fixing roller 30 or the heating film 16. Then, while the sticking substance Tc passes the pressure decreasing region Xd via the second pressure peak portion Xp to reach the heating contact portion exit Xout, the contact areas with the fixing roller 30 and the heating film 16 are increased again, so that the adhesion force of the sticking substance Tc is recovered.

However, the adhesion force of the sticking substance Tc is recovered comparatively slower in the heating film 16 having lower elasticity than in the fixing roller 30. Furthermore, since the pressure decreasing region Xd is located in a region on the downstream side of the heating contact portion N2 in the rotational direction of the heating film 16, a distance from the pressure decreasing region Xd to the heating contact portion exit Xout is shorter than a distance from the heating contact portion entrance Xin to the pressure decreasing region Xd.

Therefore, the sticking substance Tc sticking to the heating film 16 can be suppressed by making the sticking substance Tc reach the heating contact portion exit Xout before the sticking force of the sticking substance Tc to the heating film 16 has recovered sufficiently.

The above-described mechanism for preventing the sticking substance Tc from adhering to the heating film 16 shows that it is much more advantageous that the pressure decreasing region Xd be provided in a position close to the heating contact portion exit Xout.

On the other hand, the sticking substance Tc adhering to the surface of the fixing roller 30 is fixed to the recording material P at the fixing nip portion N1 in the next printing operation and discharged. Since the amount of the sticking substance Tc is very small, this sticking substance Tc is less noticeable on an image, and thus the image is less likely to be considered as a defective image. Therefore, the sticking substance Tc does not accumulate to form a lump on the heating film 16.

Figure 11:
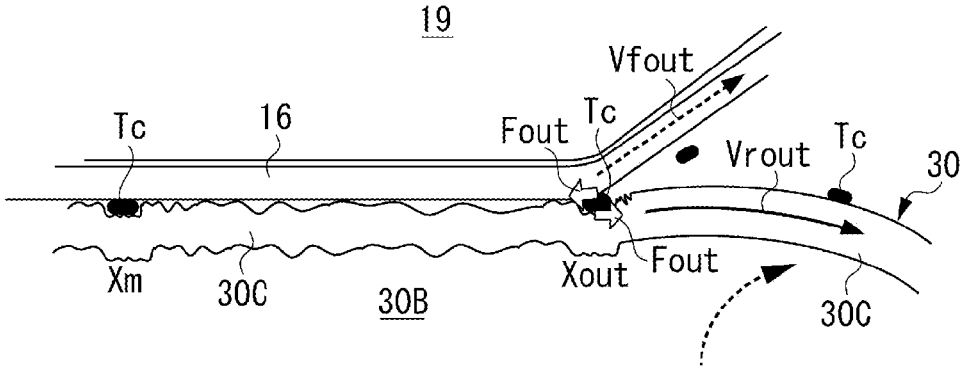
FIG. 11 is a cross-sectional view illustrating a force applied to the sticking substance at a heating contact portion according to a comparison example.

A configuration and an operational effect unique to the present exemplary embodiment will be described. FIG. 11 is a diagram illustrating circumferential speed of each member and a force applied to the sticking substance Tc in the heating contact portion N2 of a fixing device which does not have the pressure decreasing region Xd and the second pressure peak portion Xp in the heating contact portion N2. The fixing device in FIG. 11 is referred to as a fixing device of a second comparison example.

The pressure in the heating contact portion N2 of the fixing device of the second comparison example gradually decreases from the first pressure peak portion Xm toward the downstream in the rotational direction of the heating film 16.

When the elastic layer 30B of the fixing roller 30 restores from a compressed state, since the heating contact portion exit Xout with lower pressure is provided thereon, the elastic layer 30B easily expand not only in the radial direction of the fixing roller but also in the rotational direction of the heating film 16. As a result, expansion in the outer diameter of the fixing roller 30 (expansion in the radial direction) at the heating contact portion exit Xout is smaller than that of the present exemplary embodiment. Accordingly, the periphery speed difference between the surface of the fixing roller 30 and the surface of the heating film 16 is also smaller than that of the present exemplary embodiment.

Further, in the heating contact portion exit Xout, the surface of the heating film 16 and the surface of the fixing roller 30 start separating from each other. Therefore, a shearing force Fout is difficult to act between the sticking substance Tc and the surface of the heating film 16, and between the sticking substance Tc and the surface of the fixing roller 30.

Because the contact pressure between the surface of the heating film 16 and the surface of the fixing roller 30 is decreased, even if the peripheral speed difference exists between the surface of the heating film 16 and the surface of the fixing roller 30, the shearing force applied to the sticking substance Tc will be smaller.

Accordingly, when the sticking substance Tc adhering to the heating film 16 passes through the heating contact-press portion N2, the adhesion to the heating film 16 is merely increased but hardly be weakened, and thus the sticking substance Tc passes through the heating contact portion exit Xout while adhering to the heating film 16.

Figure 12A:
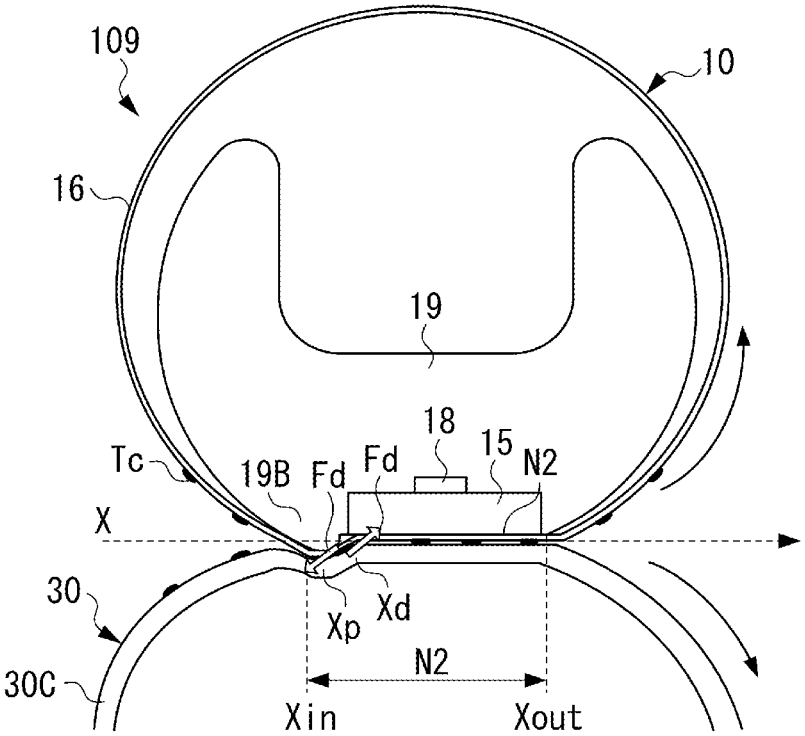
FIG. 12A is a diagram illustrating a shearing force applied to the sticking substance at the heating contact portion according to the comparison example.
Figure 12B:
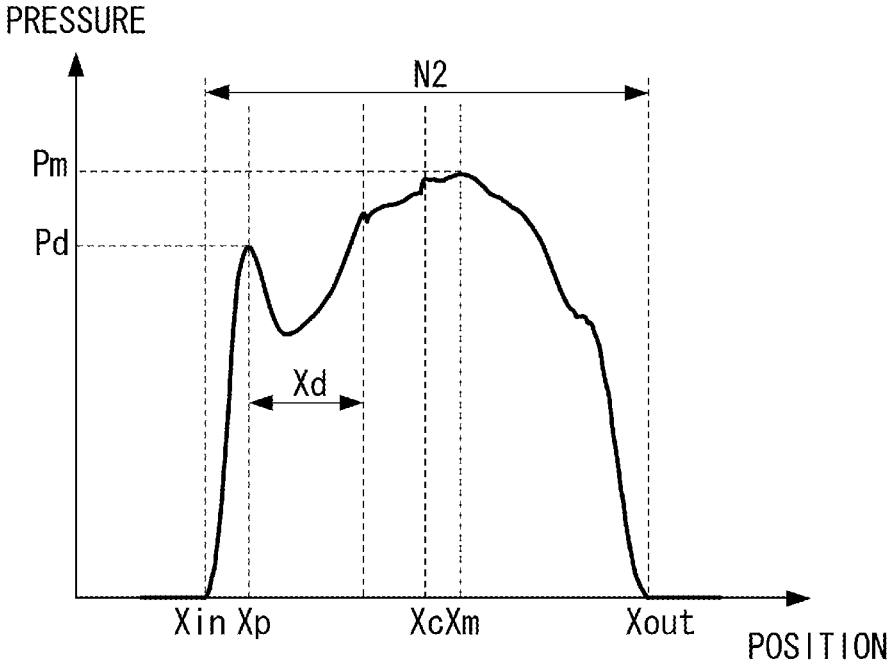
FIG. 12B is a graph illustrating pressure distribution of the heating contact portion according to the comparison example.

Next, a fixing device as illustrated in FIG. 12, in which the pressure decreasing region Xd is formed on the upstream side further than a center Xc of the heating contact portion N2 in the rotational direction of the heating film 16, will be described. This fixing device is referred to as a fixing device of a first comparison example.

In the same manner as the present exemplary embodiment, in the fixing device of the first comparison example, the sticking substance Tc receives the shearing force Fd in the pressure decreasing region Xd, so that the adhesion force of the sticking substance Tc to the heating film 16 is weakened, or the sticking substance Tc is separated from the fixing roller 30 or the heating film 16.

However, because the pressure decreasing region Xd is located on the upstream side further than the center Xc of the heating contact portion N2 in the rotational direction of the heating film 16, the distance from the pressure decreasing region Xd to the heating contact portion exit Xout is longer than the distance from the heating pressure contact entrance Xin to the pressure decreasing region Xd.

Accordingly, even if the adhesion force with respect to the heating film 16 is weakened or the sticking substance Tc is separated from the heating film 16 in the pressure decreasing region Xd, until the sticking substance Tc reaches the heating contact portion exit Xout, the adhesion force to the heating film 16 recovers by receiving heat and pressure for a long period of time. As a result, the sticking substance Tc passes through the heating contact portion Xout while adhering to the surface of the heating film 16.

As described above, with the fixing devices of the first comparison example and the second comparison example, the sticking substance Tc is more likely to stick to the heating film 16 compared to the fixing devices of the present exemplary embodiment.

Therefore, one aspect of the present exemplary embodiment is to form the pressure decreasing region Xd on the downstream side further than the center Xc of the heating contact portion N2 in the rotational direction of the heating film 16. Then, the second pressure peak portion Xp where the pressure is partially increased is formed on the downstream side further than the pressure decreasing region Xd in the rotational direction of the heating film 16.

With the above-described aspect, the sticking substance Tc adhering to the surface of the fixing roller 30 can be prevented from adhering to the surface of the heating film 16.

Experimental Result

An experiment for confirming the effect of preventing the sticking substance Tc from adhering to the surface of the heating film 16 of the fixing device 109 according to the present exemplary embodiment has been performed by using an image forming apparatus. The image forming apparatus used in the experiment is a laser beam printer having a processing speed of 90 mm/s, capable of performing a full-color print output at 14 sheets/min.

A configuration of the fixing device 109 according to the present exemplary embodiment used in the experiment will be described. A general configuration of the fixing device 109 is the same as that illustrated in FIG. 2. A general configuration of the heater 15 is the same as that illustrated in FIG. 3.

The heater 15 is provided with the heat generation resistor 15B formed of silver and palladium having a thickness of 10 μm and a width of 4.0 mm, which is disposed on a heater substrate 15A formed of alumina having a thickness of 1.0 mm and a width of 6.0 mm. This heat generation resistor 15B is covered with a glass layer as a protective layer 15C having a thickness of 60 μm. The heating film is provided with a release layer formed of PFA resin having a thickness of 20 μm, which is disposed on a film base layer formed of polyimide resin having an inner diameter of 20 mm and a thickness of 30 μm.

The fixing roller 30 is configured in such a manner that the elastic layer 30B formed of silicon rubber having a thickness of 3.0 mm and a thermal conductivity of 0.2 W/m·K is formed on the aluminum core metal 30A having an outer diameter of 14 mm, and the release layer 30C formed of PFA resin having a thickness of 20 μm is disposed as an outermost layer.

Asker C hardness of the fixing roller 30 is 45°. The Asker C hardness is measured by an Asker durometer type C (manufactured by Kobunshi Kagaku Co., Ltd.) with a load of 9.8N (1 kgf). Micro hardness of the fixing roller 30 is 50°. The micro hardness is measured by a micro rubber durometer MD-1 using a type A indentor (manufactured by Kobunshi Kagaku Co., Ltd.).

In the fixing roller 30, both end portions in the lengthwise direction of the core metal 30A of the fixing roller 30 are rotatably supported by the shaft bearings (not illustrated).

The pressure unit 50 is configured by externally fitting the pressure film 51 onto the pressure film guide 52 that includes LCP resin. The pressure film 51 is provided with a release layer formed of PFA resin having a thickness of 20 μm, which is disposed on a film base layer formed of polyimide resin having an inner diameter of 20 mm and a thickness of 30 μm.

As a lubricant agent, 500 mg of grease is applied between the heater 15 and the hating film 16, and between the pressure film guide 52 and the pressure film 51.

The heating film guide 19 and the heater 15 are urged to the surface of the fixing roller 30 by a pressure force of 176.4N (18 kgf) via the heating film 16, so as to form the heating contact portion N2 having a width of 7.0 mm. The pressure film guide 52 is urged to the surface of the fixing roller 30 by a pressure force of 176.4N (18 kgf) via the pressure film 51, so as to form the fixing nip portion N1 having a width of 7.0 mm.

The discharge roller 111 is disposed on a position 60 mm ahead from the exit of the fixing nip portion N1 in the recording material conveyance direction. After fixing processing is performed on the recording material P at the fixing nip portion N1, the recording material P is conveyed to the discharge roller 111, so as to be discharged to the discharge tray 112 by the discharge roller 111.

Figure 19:
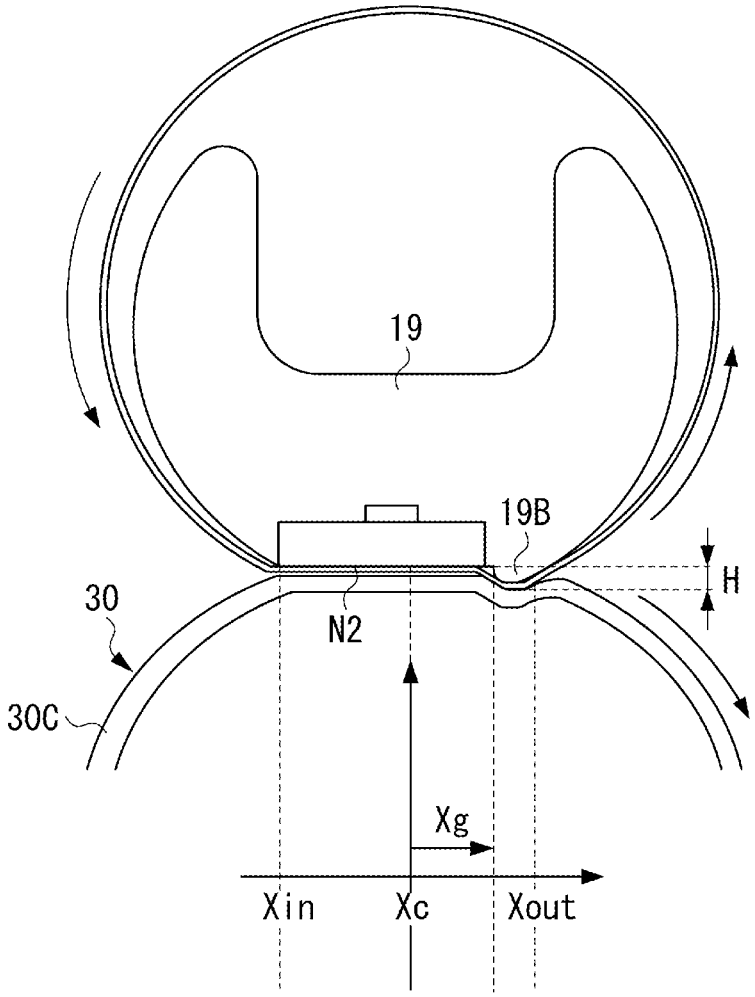
FIG. 19 is a diagram illustrating a position of a protruding portion of the fixing device.

As illustrated in FIG. 5A, in each of the fixing devices of the first exemplary embodiment through a third exemplary embodiment, the pressure decreasing region Xd is formed by providing the protruding portion 19B on the downstream side further than the center Xc of the heating contact portion N2 of the heating film guide 19 in the rotational direction of the heating film 16. In the first exemplary embodiment through the third exemplary embodiment, a protruding amount H of the protruding portion 19B from a heater glass surface of the heating film guide 19, and a position of the protruding portion 19B (distance Xg from the center Xc of the heating contact portion N2) illustrated in FIG. 19 are different from each other. The distance Xg is a distance moved in the rotational direction of the heating film 16 from the center Xc of the heating contact portion N2 as a reference.

Next, the fixing devices of the first comparison example and the second comparison example will be described.

As illustrated in FIG. 12, the protruding portion 19B of the fixing device of the first comparison example is disposed on the upstream side further than the center Xc of the heating contact portion N2 in the rotational direction of the heating film 16. In FIG. 19, a position of the protruding portion 19B of the fixing device of the first comparison example is Xg=−3.0 mm.

The fixing device of the second comparison example is not provided with the protruding portion 19B. Therefore, the pressure decreasing region Xd is not formed in the heating contact portion N2.

Figure 13:
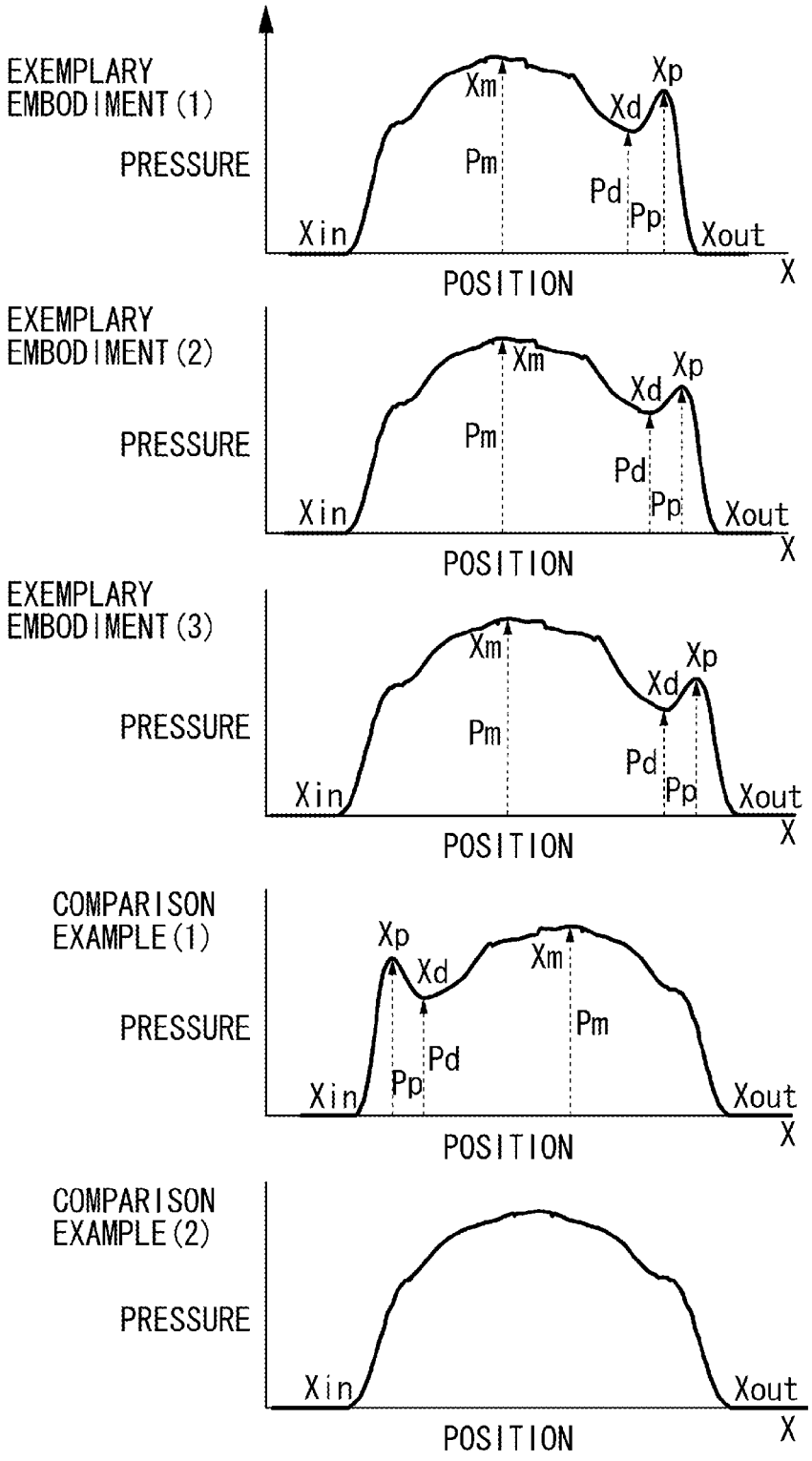
FIG. 13 illustrates graphs for comparing pressure distribution of the heating contact portions of exemplary examples and the comparison examples.

Measurement results of the pressure distributions of the heating contact portions N2 in the rotational direction of the heating films 16 for the first through the third exemplary embodiment and the first and the second comparison examples obtained by using the above-described pressure distribution measurement system are illustrated in FIG. 13.

In each of the first working example through the third working example, it is confirmed that the pressure decreasing region Xd is formed on the downstream side further than the center Xc of the heating contact portion N2 in the rotational direction of the heating film 16.

By using a commercially-available general A4-size laser beam printer (LBP) printing paper (basis weight 80 g/m$^2$), images in a printing ratio of 5% are printed by the image forming apparatuses respectively employing the fixing devices of the first exemplary embodiment through the third exemplary embodiment, and the first comparison example and the second comparison example. The experiment environment has a room temperature of 15° C. with 15% humidity.

In each of the image forming apparatuses used in this experiment, when full-color printing is executed in the environment at a room temperature of 15° C., the heater 15 is controlled to have a target temperature of 200° C. in a fixing mode in which fixing processing is performed on a recording material having a basis weight of 80 g/m$^2$.

The height H of the protruding portion 19B of the heating film guide 19 and the distance Xg from the center Xc of the heating contact portion N2 for each of the first exemplary embodiment through the third exemplary embodiment, and the first comparison example and the second comparison example are illustrated in a table 1. The height H of the protruding portion 19B and the distance Xg from the center Xc of the heating contact portion N2 are illustrated in FIG. 19. The ratio of a surface pressure Pd of the pressure decreasing region Xd to a surface pressure Pm of the first pressure peak portion Xm, and the ratio of a surface pressure Pp of the second pressure peak portion Xp to a surface pressure Pm of the first pressure peak portion Xm are also illustrated in the table 1.

TABLE 1

| | Heating Film Guide (Protruding Portion 19B) | | Pressure Distribution | | Experimental |
|---|---|---|---|---|---|
| Fixing Device | Height H | Xg | Pd/Pm | Pp/Pm | Result |
| Exemplary Embodiment (1) | 0.3 mm | 3.0 mm | 63% | 88% | 30000 sheets |
| Exemplary Embodiment (2) | 0.5 mm | 3.5 mm | 57% | 78% | 30000 sheets |
| Exemplary Embodiment (3) | 0.5 mm | 4.0 mm | 57% | 67% | 30000 sheets |
| Comparison Example (1) | 0.3 mm | −3.0 mm | — | — | 2000 sheets |
| Comparison Example (2) | none | none | — | — | 2000 sheets |

In the first exemplary embodiment through the third exemplary embodiment, the sticking substance Tc does not stick to the surface of the heating film 16 in a case where 30000 sheets have been printed. It is confirmed that the first through the third exemplary examples are effective regardless of the parameters such as the height H of the protruding portion 19B and the distance Xg from the center Xc of the heating contact portion N2 and the magnitude of the surface pressure Pp of the second pressure peak portion Xp.

On the contrary, in the first comparison example and the second comparison example, when 2000 sheets of the recording materials P have been printed, uneven gloss of the image is observed therein. When the interiors of these fixing devices are examined, the sticking substances Tc have stuck to the surfaces of the heating films 16. It is confirmed that the operational effect achieved by the first through the third exemplary embodiments cannot be achieved by the configuration in which the pressure decreasing region Xd and the second pressure peak portion Xp are not formed in the heating contact portion N2, or the configuration in which the pressure decreasing region Xd is formed on the upstream side further than the center Xc of the heating contact portion N2 in the rotational direction of the heating film 16.

As described above, in the fixing device 109 according to the present exemplary embodiment, the pressure decreasing region Xd is formed on the downstream side further than the center Xc of the heating contact portion N2 in the rotational direction of the heating film 16. Then, the second pressure peak portion Xp in which the pressure thereof is partially increased is formed on the downstream side further than the pressure decreasing region Xd in the rotational direction of the heating film 16. With this configuration, by applying the shearing force to the sticking substance Tc between the surface of the heating film 16 and the surface of the fixing roller 30, adhesion force of the sticking substance Tc to the surface of the heating film 16 is weakened, so that the sticking substance Tc can be prevented from adhering to the heating film 16.

Through the above configuration, the sticking substance Tc can be prevented from accumulating on the surface of the heating film 16, and thus a favorable printing image can be maintained.

A variation example of the present exemplary embodiment will be described. In the present exemplary embodiment, the protruding portion 19A is formed on the heating film guide 19. However, the protruding portion 19B may be formed on the heater 15.

Figure 16:
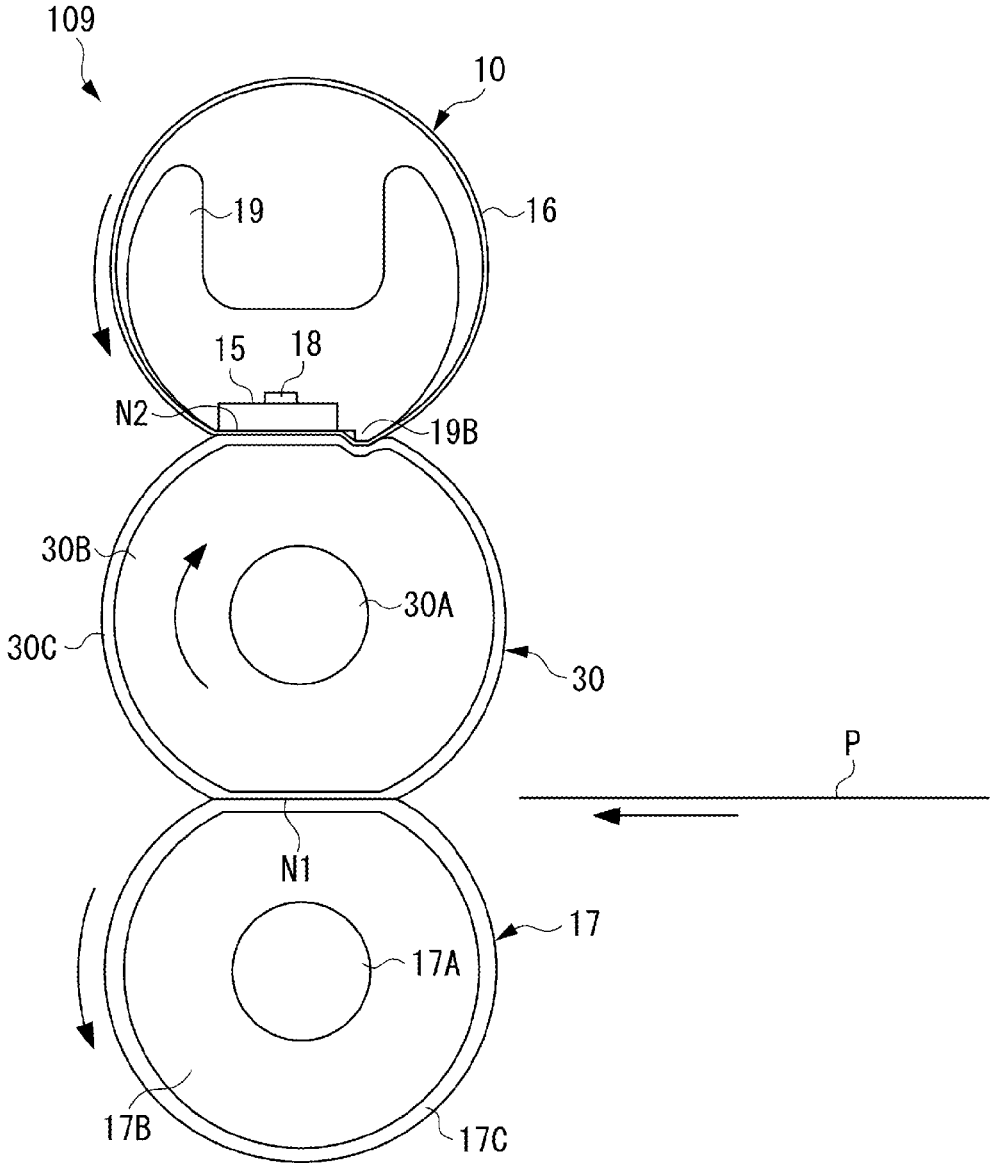
FIG. 16 is a cross-sectional view illustrating a general configuration of a fixing device according to a variation of the first exemplary embodiment.

Further, in the fixing device 109 according to the present exemplary embodiment, the pressure film 51 is used as a rotatable pressure member. However, as illustrated in FIG. 16, a configuration using the pressure roller 17 may be also employed.

Figure 17:
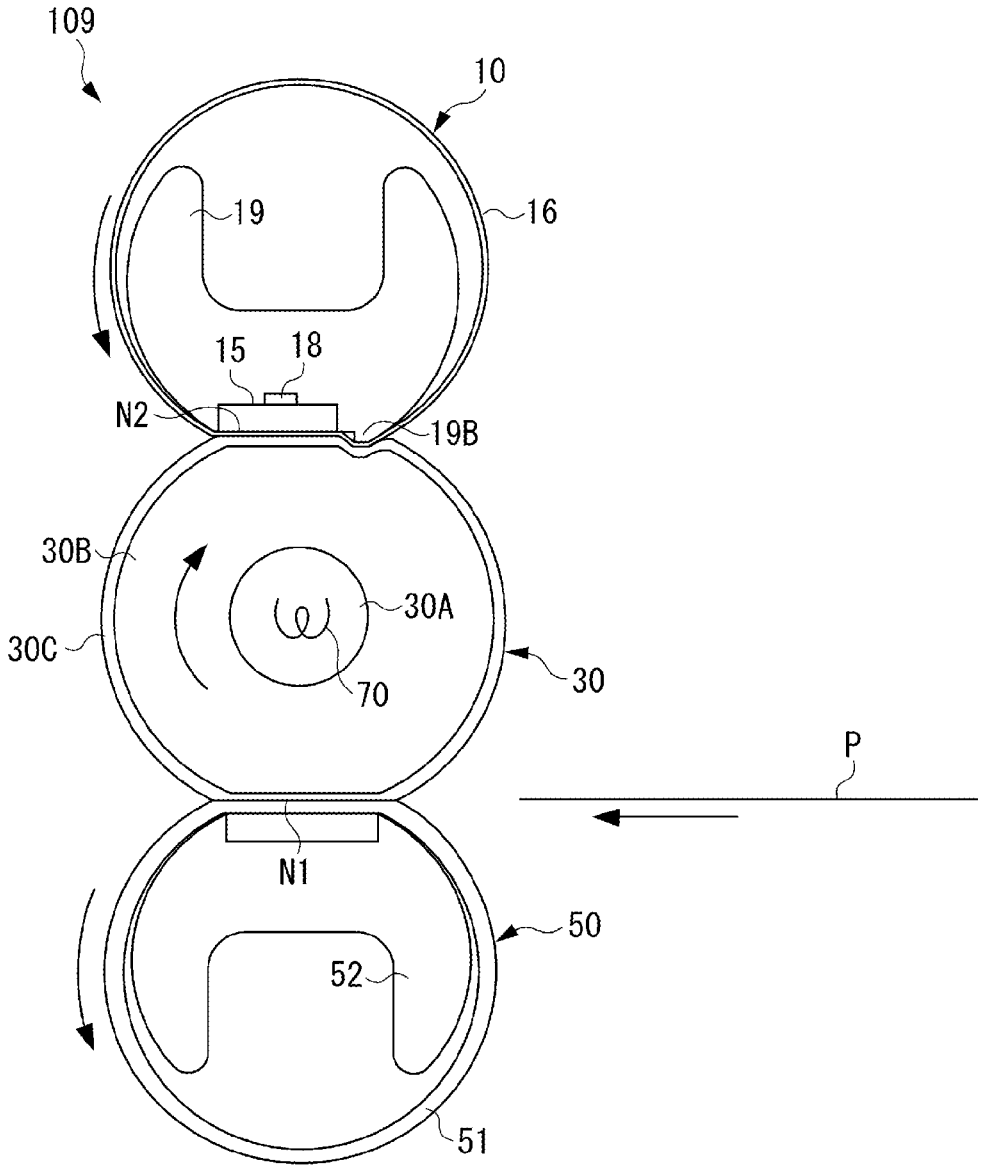
FIG. 17 is a cross-sectional view illustrating a general configuration of a fixing device according to the variation of the first exemplary embodiment.

In addition, a configuration in which the fixing roller 30 includes a heat source may be employed. For example, as illustrated in FIG. 17, a configuration in which the fixing roller 30 is provided with a built-in halogen heater 70 may be considered.

Figure 18:
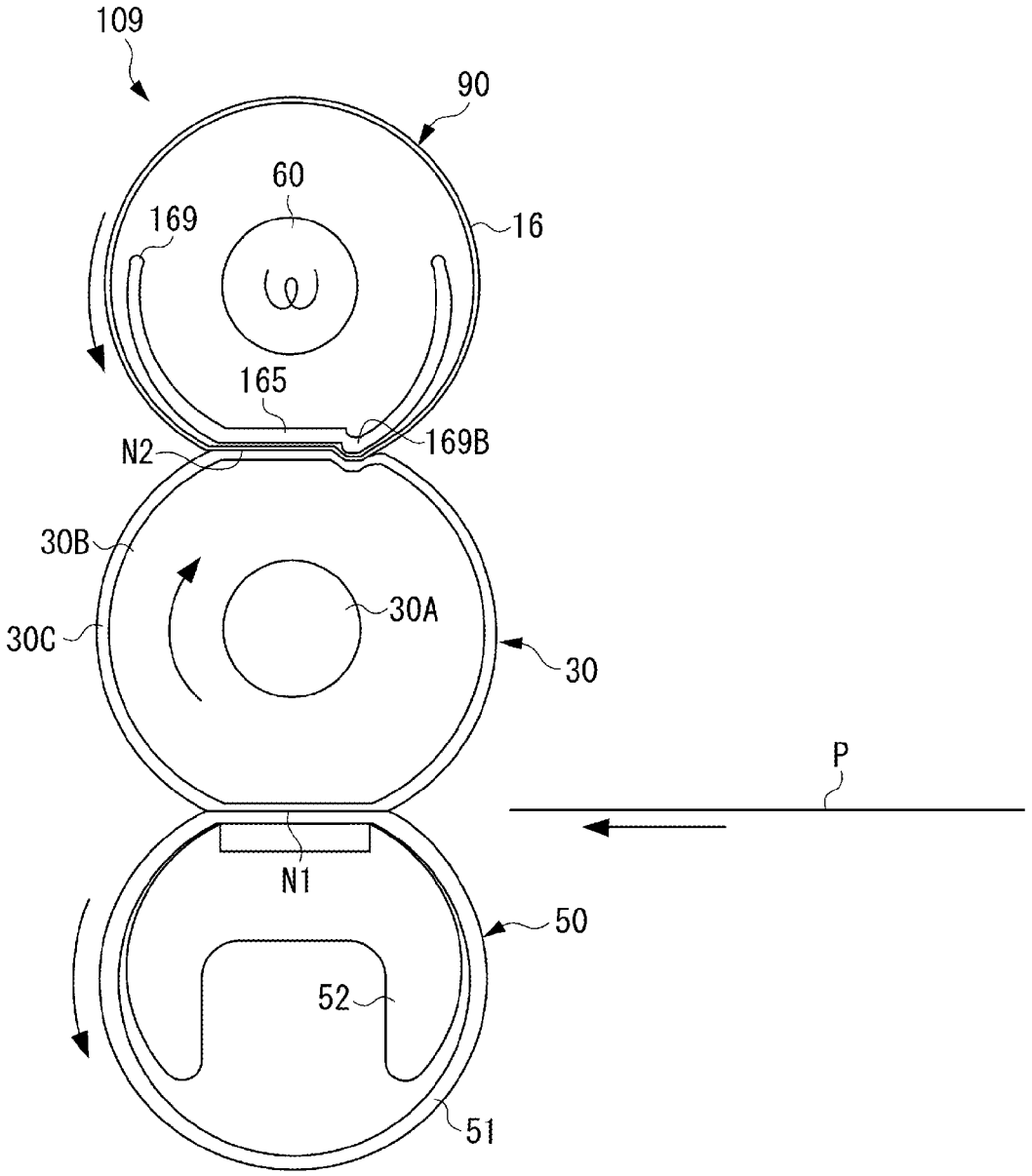
FIG. 18 is a cross-sectional view illustrating a general configuration of a fixing device according to the variation of the first exemplary embodiment.

Further, in the fixing device 109 according to the present exemplary embodiment, the ceramic heater (heater 15) is used as a heat source. However, the configuration is not limited thereto. For example, as illustrated in FIG. 18, a configuration in which a halogen heater 60 built into the heating film 16, configured to heat the inner surface of the heating film 16 with radiation heat, is provided instead of the ceramic heater while using a metallic plate such as aluminum as a heating contact portion forming member may be also employed.

A second exemplary embodiment will be described.

Figure 14:
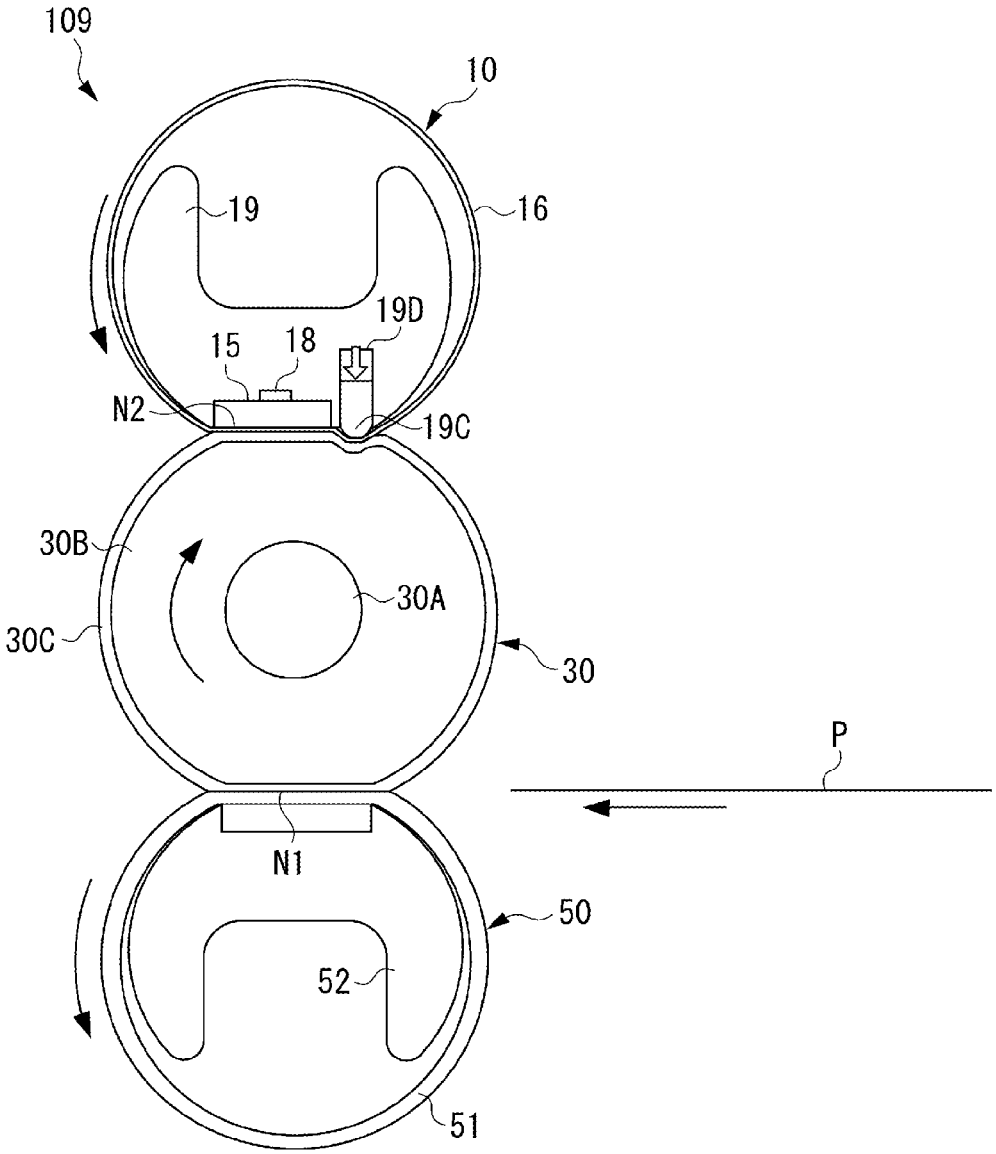
FIG. 14 is a cross-sectional view illustrating a general configuration of a fixing device according to the second exemplary embodiment.

Other example of the fixing device will be described. FIG. 14 is a schematic cross-sectional view illustrating a general configuration of a fixing device according to the present exemplary embodiment. In the present exemplary embodiment, the same reference numbers are applied to the members and portions which are common to those in the fixing device 109 of the first exemplary embodiment, and the same descriptions of those members and portions will be referred thereto.

Figure 15:
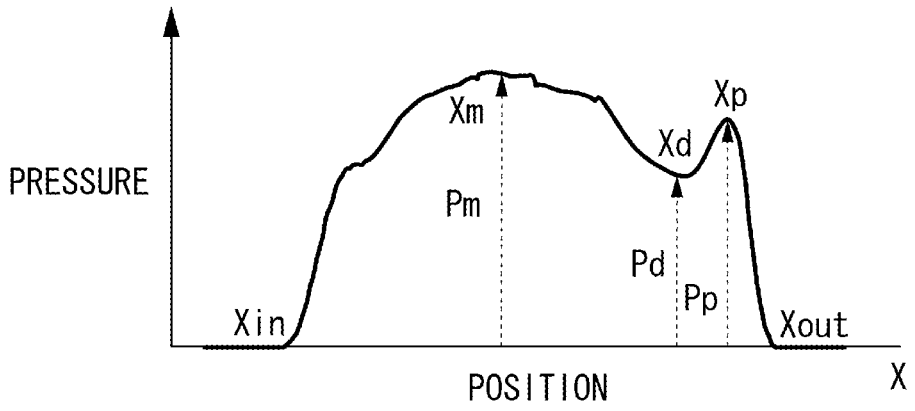
FIG. 15 is a graph illustrating pressure distribution of a heating contact portion according to the second exemplary embodiment.

The fixing device 109 according to the present exemplary embodiment is configured in such a manner that a pressing component 19C, a member different from the heating film guide 19, is pressed by an independent pressure unit 19D provided separately from the pressure unit that presses the heating film guide 19 to the fixing roller 30. The pressure distribution of the heating contact portion N2 in the rotational direction of the heating film 16 is illustrated in FIG. 15. In the same manner as the first exemplary embodiment, the pressure decreasing region Xd is formed on the downstream side further than the center Xc of the heating contact portion N2 in the rotational direction of the heating film 16, and the second pressure peak portion Xp is formed on the downstream side further than the pressure decreasing region Xd in the rotational direction of the heating film 16.

Since the second pressure peak portion Xp is formed by the independent pressure unit 19D, even if the hardness of the elastic layer 30B of the fixing roller 30 varies due to a durability factor, the second pressure peak portion Xp and the pressure decreasing region Xd can be formed stably.

As described above, according to the present exemplary embodiment, regardless of the hardness variation of the elastic layer 30B of the fixing roller 30, suppressing effect of the sticking substance with respect to the heating film 16 can be maintained stably.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-147146 filed Jun. 29, 2012, which is hereby incorporated by reference herein in its entirety.

What is claimed is:

1. A fixing device configured to fix a toner image on a recording material by heating while conveying the recording material that bears the toner image by a nip portion, the fixing device comprising:

a fixing roller including a rubber layer;

a rotating member configured to form a contact portion with the fixing roller; and a pressure member configured to form the nip portion by contacting an outer surface of the fixing roller, wherein the rotating member transfers heat to the fixing roller via the contact portion, wherein a pressure distribution in the contact portion includes a pressure decreasing region, where pressure is increased after being decreased, at a downstream side further than a center of the contact portion in the rotational direction of the rotating member, and wherein a most downstream pressure peak at the downstream side than the pressure decreasing region in the contact portion, is lower than a highest pressure peak at an upstream side than the pressure decreasing region in the contact portion.

2. The fixing device according to claim 1, wherein the rotating member is a cylindrical film, and wherein the fixing device further comprises a contact portion forming member contacting with an inner surface of the film and configured to form the contact portion with the fixing roller via the film.

3. The fixing device according to claim 2, wherein the contact portion forming member includes a protruding portion protruding toward the fixing roller on a downstream side further than a center of the contact portion in a rotational direction of the film.

4. The fixing device according to claim 2, wherein the contact portion forming member includes a heater and a supporting member configured to support the heater.

5. The fixing device according to claim 4, wherein the protruding portion is formed on the supporting member.

6. The fixing device according to claim 3, wherein the contact portion forming member includes a heater, and wherein the protruding portion is formed on the heater.

7. The fixing device according to claim 5, wherein the protruding portion protrudes further than a surface of the heater which makes contact with the film.

8. The fixing device according to claim 2, further comprising a heater configured to heat an inner surface of the film with radiation heat.

9. A fixing device configured to fix a toner image on a recording material by heating while conveying the recording material that bears the toner image by a nip portion, the fixing device comprising:

a fixing roller including a rubber layer;

a cylindrical film;

a contact portion forming member configured to make contact with an inner surface of the film, wherein the contact portion forming member is configured to form a contact portion with the fixing roller via the film; and a pressure member configured to form the nip portion by contacting an outer surface of the fixing roller, wherein heat of the film transfers from the film to the fixing roller via the contact portion, wherein a surface of the contact portion forming member opposite to the inner surface of the film includes, at a downstream side than a center of the contact portion in a rotational direction of the film, a flat surface portion parallel to the recording material conveyed at the nip portion and a protruding portion protruding toward the fixing roller at a downstream side further than the flat surface portion in the rotational direction of the film, and wherein a space is provided between the inner surface of the film and the contact portion forming member at a vicinity of a boundary position between the flat surface portion and the protruding portion.

10. The fixing device according to claim 9, wherein the contact portion forming member includes a heater and a supporting member configured to support the heater.

11. The fixing device according to claim 10, wherein the protruding portion is formed on the supporting member.

12. The fixing device according to claim 9, wherein the contact portion forming member includes a heater, and wherein the protruding portion is formed on the heater.

13. The fixing device according to claim 11, wherein the protruding portion protrudes further than a surface of the heater which makes contact with the film.

14. The fixing device according to claim 9, further comprising a heater configured to heat an inner surface of the film with radiation heat.

* * * * *